US006969540B2

(12) United States Patent
Seaver et al.

(10) Patent No.: US 6,969,540 B2
(45) Date of Patent: Nov. 29, 2005

(54) ELECTROSTATIC SPRAY COATING APPARATUS AND METHOD

(75) Inventors: Albert E. Seaver, Woodbury, MN (US); William K. Leonard, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/815,363

(22) Filed: Apr. 1, 2004

(65) Prior Publication Data

US 2004/0185180 A1 Sep. 23, 2004

Related U.S. Application Data

(62) Division of application No. 09/841,380, filed on Apr. 24, 2001, now abandoned.

(51) Int. Cl.[7] ..... B05B 5/14

(52) U.S. Cl. ..... 427/482; 427/483; 427/421; 427/428

(58) Field of Search ..... 427/458, 475, 427/482–485, 421, 428; 118/629, 630; 101/170, 492

(56) References Cited

U.S. PATENT DOCUMENTS

| | | | |
|---|---|---|---|
| 1,043,021 | A | 10/1912 | Mayer |
| 2,105,488 | A | 1/1938 | Massey et al. |
| 2,105,981 | A | 1/1938 | Massey et al. |
| 2,229,620 | A | 1/1941 | Bradner |
| 2,229,621 | A | 1/1941 | Bradner |
| 2,237,068 | A | 4/1941 | Bradner |
| 2,245,045 | A | 6/1941 | Montgomery et al. |
| 2,447,664 | A | 8/1948 | Pegg |
| 2,685,536 | A | 8/1954 | Starkey et al. |
| 2,695,002 | A | 11/1954 | Miller |
| 2,710,589 | A | 6/1955 | Brunner |
| 2,733,171 | A | 1/1956 | Ransburg |
| 2,762,331 | A | 9/1956 | Henderson |
| 2,809,128 | A | 10/1957 | Miller |

(Continued)

FOREIGN PATENT DOCUMENTS

| | | | | |
|---|---|---|---|---|
| DE | 198 14 689 A1 | | 10/1999 | |
| GB | 1 278 099 | | 6/1972 | |
| GB | 1278099 A | * | 6/1972 | ..... B05C/11/02 |

OTHER PUBLICATIONS

"Evolution of Coating", George L. Booth, Published by Gorham International Inc., Gorham, Maine, vol. 1, Dec. 1995.

(Continued)

*Primary Examiner*—Fred J. Parker
(74) *Attorney, Agent, or Firm*—Brian E. Szymanski

(57) ABSTRACT

A liquid coating is formed on a substrate by electrostatically spraying drops of the liquid onto a liquid-wetted conductive transfer surface and transferring a portion of the thus-applied liquid from the transfer surface to the substrate. Optionally, one or more nip rolls force the substrate against the transfer surface, thereby decreasing the time required for the drops to spread and coalesce into the coating. Preferably, the coating is passed through an improvement station comprising two or more pick-and-place devices that improve the uniformity of the coating. The coating can be transferred from the conductive transfer surface to a second transfer surface and thence to the substrate. Insulative substrates such as plastic films can be coated without requiring substrate pre-charging or post-coating neutralization. Porous substrates such as woven and nonwoven webs can be coated without substantial penetration of the coating into or through the substrate pores.

32 Claims, 17 Drawing Sheets

U.S. PATENT DOCUMENTS

| | | | | |
|---|---|---|---|---|
| 2,833,666 | A | | 5/1958 | Neidich |
| 2,893,894 | A | | 7/1959 | Ransburg |
| 2,994,618 | A | | 8/1961 | Landgraf |
| 3,001,890 | A | * | 9/1961 | Sedlacsik, Jr. ..... 427/484 |
| 3,018,757 | A | | 1/1962 | Loppnow |
| 3,486,483 | A | | 12/1969 | Tilney et al. |
| 3,726,701 | A | | 4/1973 | Nishikawa et al. |
| 3,730,433 | A | | 5/1973 | Scharfenberger |
| 3,920,862 | A | | 11/1975 | Damschroder et al. |
| 4,073,966 | A | | 2/1978 | Scholes et al. |
| 4,170,193 | A | | 10/1979 | Scholes et al. |
| 4,267,215 | A | | 5/1981 | Riggs |
| 4,378,390 | A | | 3/1983 | Yoshida et al. |
| 4,503,802 | A | | 3/1985 | Keller et al. |
| 4,569,864 | A | | 2/1986 | McIntyre |
| 4,748,043 | A | | 5/1988 | Seaver et al. |
| 4,749,125 | A | | 6/1988 | Escallon et al. |
| 4,788,016 | A | | 11/1988 | Colclough et al. |
| 4,830,872 | A | | 5/1989 | Grenfell |
| 4,830,873 | A | | 5/1989 | Benz et al. |
| 4,846,407 | A | | 7/1989 | Coffee et al. |
| 4,847,110 | A | | 7/1989 | Nakajima et al. |
| 4,854,506 | A | | 8/1989 | Noakes et al. |
| 4,990,359 | A | | 2/1991 | Knobbe |
| 5,049,404 | A | | 9/1991 | Kisler et al. |
| 5,222,663 | A | | 6/1993 | Noakes et al. |
| 5,326,598 | A | | 7/1994 | Seaver et al. |
| 5,332,797 | A | | 7/1994 | Kessel et al. |
| 5,409,732 | A | * | 4/1995 | Leonard et al. ..... 427/10 |
| 5,447,474 | A | | 9/1995 | Chang |
| 5,460,120 | A | | 10/1995 | Paul et al. |
| 5,536,314 | A | | 7/1996 | Rannestad |
| 5,585,545 | A | | 12/1996 | Bennett et al. |
| 5,596,930 | A | | 1/1997 | Keller et al. |
| 5,599,602 | A | | 2/1997 | Leonard et al. |
| 5,620,514 | A | | 4/1997 | Munter et al. |
| 5,702,527 | A | | 12/1997 | Seaver et al. |
| 5,733,608 | A | | 3/1998 | Kessel et al. |
| 5,858,545 | A | | 1/1999 | Everaerts et al. |
| 5,871,585 | A | | 2/1999 | Most et al. |
| 5,954,907 | A | | 9/1999 | LaRose et al. |
| 6,063,450 | A | * | 5/2000 | Bernert et al. ..... 427/475 |
| 6,214,112 | B1 | | 4/2001 | Plomer |
| 6,503,325 | B1 | | 1/2003 | Hess |
| 6,579,574 | B2 | | 6/2003 | Seaver et al. |
| 6,737,113 | B2 | | 5/2004 | Leonard et al. |

OTHER PUBLICATIONS

"The Coating Machine", Booth, G.L., *Pulp and Paper Manufacture*, vol. 8, *Coating, Converting and Processes*, pp. 76–87, Third Edition, 1990.

*Coating and Drying Defects*, Gutoff and Cohen, John Wiley & Sons, New York, 1995.

"Multiple Roll Systems: Residence Times and Dynamic Response", D.F. Benjamin, T.J.Anderson, and L.E. Scriven, AlChEJ., V41, p. 2198, 1995.

"Multiple Roll Systems: Steady–State Operation", D. F. Benjamin, T. J. Anderson, and L.E. Scriven, AlChEJ., V41, p. 1045, 1995.

Seaver, A.E., Analysis of Electrostatic Measurements on Non–Conducting Webs; *J. Electrostatics*, vol. 35, No. 2 (1995), pp. 231–243.

Polymer Handbook, 3$^{rd}$ Edition, Editors J. Brandrup and E.H. Immergut, Wiley, New York (1989), p. V/101.

Cross, J. A. Electrostatics: Principles, Problems and Applications, Adam Hilger, Bristol (1987), p. 81.

Dangelmayer, G.T., ESD Program Management, Van Nostrand Reinhold, New York (1990) p. 40.

* cited by examiner

ELECTROSTATIC SPRAY COATING APPARATUS AND METHOD

CROSS REFERENCE TO RELATED APPLICATION

This application is a divisional of U.S. Ser. No. 09/841,380, filed Apr. 24, 2001, now abandoned, the disclosure of which is herein incorporated by reference.

TECHNICAL FIELD

This invention relates to devices and methods for coating substrates.

BACKGROUND

Electrostatic spray coating typically involves atomizing a liquid and depositing the atomized drops in an electrostatic field. The average drop diameter and drop size distribution can vary widely depending on the specific spray coating head. Other factors such as the electrical conductivity, surface tension and viscosity of the liquid also play an important part in determining the drop diameter and drop size distribution. Representative electrostatic spray coating heads and devices are shown in, e.g., U.S. Pat. Nos. 2,685,536; 2,695,002; 2,733,171; 2,809,128; 2,893,894; 3,486,483; 4,748,043; 4,749,125; 4,788,016; 4,830,872; 4,846,407; 4,854,506; 4,990,359; 5,049,404; 5,326,598; 5,702,527 and 5,954,907. Devices for electrostatically spraying can-forming lubricants onto a metal strip are shown in, e.g., U.S. Pat. Nos. 2,447,664; 2,710,589; 2,762,331; 2,994,618; 3,726,701; 4,073,966 and 4,170,193. Roll coating applicators are shown in, e.g., U.S. Pat. No. 4,569,864, European Published Patent Application No. 949380 A and German OLS DE 198 14 689 A1.

In general, the liquid sent to the spray coating head breaks up into drops due to instability in the liquid flow, often at least partially influenced by the applied electrostatic field. Typically, the charged drops from electrostatic spray heads are directed by electric fields towards an article, endless web or other substrate that moves past the spray head. In some applications, the desired coating thickness is larger than the average drop diameter, the drops land on top of one other, and they coalesce to form the coating. In other applications, the desired coating thickness is smaller than the average drop diameter, the drops are spaced apart at impact, and the drops must spread to form a continuous voidless coating.

SUMMARY OF THE INVENTION

In some electrostatic spray-coating processes, the desired coating thickness is less than the average diameter of the drops that will be deposited by the electrostatic spray coating head. We will refer to such processes as "thin film processes", and to the resulting coatings as "thin film coatings". The drops can be deposited apart from each other and then allowed to spread on the substrate until they form a continuous thin film coating or otherwise coalesce. For a given drop diameter, the thinner the desired coating, then the further apart the drops must land on the substrate. Likewise, for a desired coating caliper, the larger the delivered drop diameter, then the further apart the drops must land on the substrate. In either situation, once the drops reach the substrate they typically must spread and coalesce, after which the coating typically is cured or otherwise hardened, or for some applications used while in a still-wet condition. Spreading and coalescence take time. If the coating liquid can not spread and coalesce sufficiently in the available time, then voids will be present in the coating when cure, hardening or use takes place.

Similar considerations apply to coating processes in which the desired coating thickness is greater than the average drop diameter. We will refer to such processes as "thick film processes", and to the resulting coatings as "thick film coatings". A finite time will be required for the coating to level itself prior to cure, hardening or use. If leveling does not take place in time, then high and low regions may be present in the coating when cure, hardening or use takes place.

For both thin film and thick film processes, changes in the liquid (e.g., changing an ingredient such as a curable monomer, or adding an ingredient such as a low viscosity reactive diluent) may speed up the drop spreading time or coating leveling time to some extent. These changes can however adversely affect other desired properties of the final coating. Alterations designed to reduce the surface tension of the drops or roughening of the substrate can help speed up drop spreading. Increases in the temperature of the drops or substrate can speed up drop spreading or leveling. However, to produce good drop spreading or leveling, viscosity and surface tension typically already should be relatively low. In addition, many coating liquid formulations deteriorate when exposed to elevated temperatures. Consequently, large reductions in drop spreading time or leveling time are difficult to obtain via manipulation of the coating formulation, substrate or temperature.

Volatile solvents can also be added to the coating liquid. The solvent typically will encourage drop spreading or leveling, and can permit deposition of a thicker film that can be dried to the desired final coating caliper. Use of volatile solvents generally is undesirable for reasons including their potential environmental impact, flammability, cost and storage requirements.

In a continuous coating process involving a moving substrate, the time from coating to cure, hardening or use will decrease as the speed of the coating process is increased. When higher coating speeds are desired, the distance between the coating station and the point or station at which cure, hardening or use takes place may have to be increased in order to permit adequate time for drop spreading or leveling. Eventually, the required distance can become so large as to be impractical.

Accordingly, drop spreading times and coating leveling times can be significant rate-limiting factors for coating processes that involve the delivery of drops to a substrate.

The charges used in electrostatic spraying can pose additional problems. Usually the substrate (or a support under the substrate) is grounded in order to attract the atomized drops. When coating an insulated web (e.g., most plastic films) with charged atomized drops, the first few drops will charge the substrate to the same polarity as the coating drops. This substrate charge will repel further drops and discourage further coating accumulation. Substrate charge buildup typically can be dealt with by "pre-charging" the substrate (depositing a copious amount of gaseous ions of the opposite polarity onto the substrate), see, e.g., U.S. Pat. Nos. 4,748,043; 5,049,404 and 5,326,598. Usually, the excess substrate charge remaining after deposition of the atomized drops has to be neutralized so that the substrate can easily be handled and stored. Charging and then neutralizing the substrate adds cost and complexity to the coating process, and the charged substrate can pose a mild to strong shock hazard to factory workers. Substrate charge buildup can also be dealt with in part by employing larger drops and relying on the gravitational force to overcome the electrostatic repulsion of the drops from the substrate. However, because larger drops produce thicker coatings, solvent addition or a greater distance between drops often will be required to obtain the desired coating caliper, with consequent disadvantages as noted above. The larger drops will charge the substrate in any event, thereby ameliorating but not eliminating problems caused by charge buildup and the need to neutralize the coated substrate.

Electrostatic spray coating heads can also be used to coat porous (e.g., woven or nonwoven) substrates. Notwithstanding any opposite charge that may be present on the substrate, sometimes the charged atomized drops will follow electric field lines that cause the drops to penetrate deep into or even completely through the porous substrate. This penetration loss requires an increase in the applied coating weight and can make it difficult to form coatings on only one side of a porous substrate.

The present invention provides, in one aspect, a method for forming a liquid coating on a substrate comprising electrostatically spraying drops of the liquid onto a liquid-wetted conductive transfer surface, and transferring a portion of the thus-applied liquid from the transfer surface to the substrate to form the coating. In a preferred embodiment, one or more nip rolls force the substrate against the transfer surface, thereby spreading the applied drops on the transfer surface and decreasing the time required for the drops to coalesce into the coating. In another preferred embodiment, the wet coating is contacted by two or more pick-and-place devices that improve the uniformity of the coating. In a further embodiment, the coating is transferred from the conductive transfer surface to a second transfer surface and thence to the substrate. In an additional embodiment, an insulative substrate (e.g., a plastic film or other non-conductive material) is coated without requiring substrate pre-charging or post-coating neutralization. In yet another embodiment, a porous substrate is coated without substantial penetration of the coating into or through the substrate pores.

The invention also provides an apparatus for carrying out such methods. In one aspect, the apparatus of the invention comprises a conductive transfer surface that when wet with a coating composition can transfer a portion of the coating to a substrate, an electrostatic spray head for applying the coating composition to the conductive transfer surface, and, preferably, one or more nip rolls that force the substrate against the conductive transfer surface. In a further preferred embodiment, an apparatus of the invention also comprises two or more pick-and-place devices that can periodically contact and re-contact the wet coating at different positions on the substrate, wherein the periods of the pick-and-place devices are selected so that the uniformity of the coating on the substrate is improved. In another embodiment, the apparatus comprises a second transfer surface that can transfer a portion of the coating from the conductive transfer surface to the substrate.

The methods and apparatus of the invention can provide substantially uniform thin film or thick film coatings, on conductive, semi-conductive, insulative, porous or non-porous substrates. The apparatus of the invention is simple to construct, set up and operate, and can easily be adjusted to alter coating thickness and coating uniformity.

DETAILED DESCRIPTION OF THE INVENTION

Figure 1:
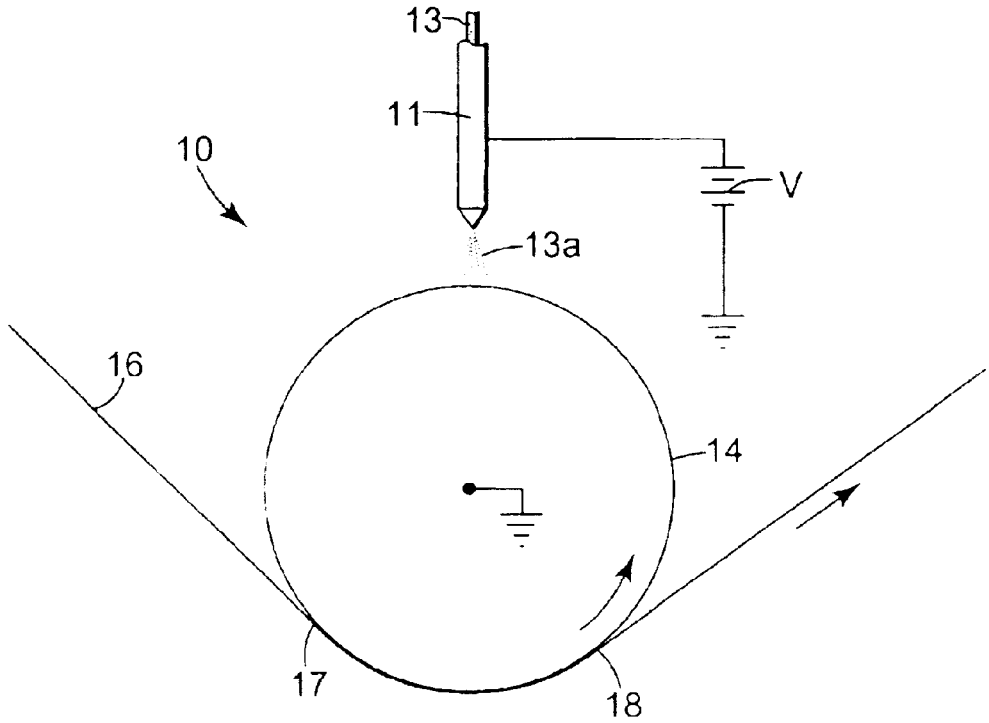
FIG. 1 is a schematic side view of an apparatus of the invention.

The invention provides a simple coating process that can be used to apply substantially uniform, void-free thin film and thick film coatings on conductive, semi-conductive, insulated, porous or non-porous substrates, using solvent-based, water-based or solventless coating compositions. The electrostatic spray apparatus of the invention is especially useful for, but not limited to, coating moving webs. If desired, the substrate can be a discrete object or a train or array of discrete objects having finite dimensions. The coatings can be formed without depositing on the substrate the electrical charges generated by the electrostatic spray coating head used to apply the coating. Referring to FIG. 1, electrostatic spray coating apparatus 10 includes electrostatic spray head 11 for dispensing a pattern of drops or mist 13*a* of coating liquid 13 onto rotating grounded drum 14. Drum 14 continuously circulates past spray head 11, periodically presenting and re-presenting the same points on the drum under spray head 11 at intervals defined by the rotational period of drum 14. A variety of types of electrostatic spray heads can be employed, including those shown in the patents referred to above. Preferably the electrostatic spray head produces a substantially uniform mist of charged droplets. More preferably the electrostatic spray head (or a series of electrostatic spray heads ganged together in a suitable array) produces a line of charged droplets. A voltage V between spray head 11 and drum 14 charges the drops of liquid 13. The electric field between spray head 11 and drum 14 directs the drops toward the surface of drum 14. As drum 14 rotates, it brings the applied drops into contact with moving web 16 at entry point 17. Even if the drops have not fully spread into a film by the time they reach entry point 17, pressure from the web between entry point 17 and separation point 18 helps to spread and coalesce the drops into a coating. At the separation point 18, part of the coating remains on web 16 while the remainder of the coating remains on drum 14. After several revolutions of drum 14, a steady state is reached, the entire surface of drum 14 becomes wet with the coating, and the amount of coating being removed by web 16 equals the amount being deposited on drum 14. The wet surface on drum 14 assists newly applied drops of liquid 13 in spreading and coalescing prior to contact with web 16. Drop spreading issues are further reduced due to the pressure exerted by web 16 on drum 14. The drops coalesce and the coating becomes continuous in a much shorter time than is the case when atomized drops are sprayed directly onto a substrate and spread at a rate based on the drop's own physical properties. This is especially helpful for thin coatings, where the drops tend to be widely separated. Web charging issues are overcome because the charged drops are neutralized when they contact the drum, and before they are transferred to the moving web.

Those skilled in the art will realize that the web can be pre-charged if desired, but that the invention makes it possible to coat insulative and semi-conductive substrates without substrate pre-charging or post-coating neutralization. Those skilled in the art will also realize that the drum or other conductive transfer surface need not be grounded. Instead, if desired, the conductive transfer surface need only be at a lower voltage than the charged atomized drops. However, it generally will be most convenient to ground the conductive transfer surface and to avoid charging the substrate. In addition, those skilled in the art will realize that the drum or other conductive transfer surface need not circulate in the same direction as the substrate or at the same speed. If desired the conductive transfer surface could circulate in the opposite direction or circulate at a speed different from that of the substrate.

Figure 2:
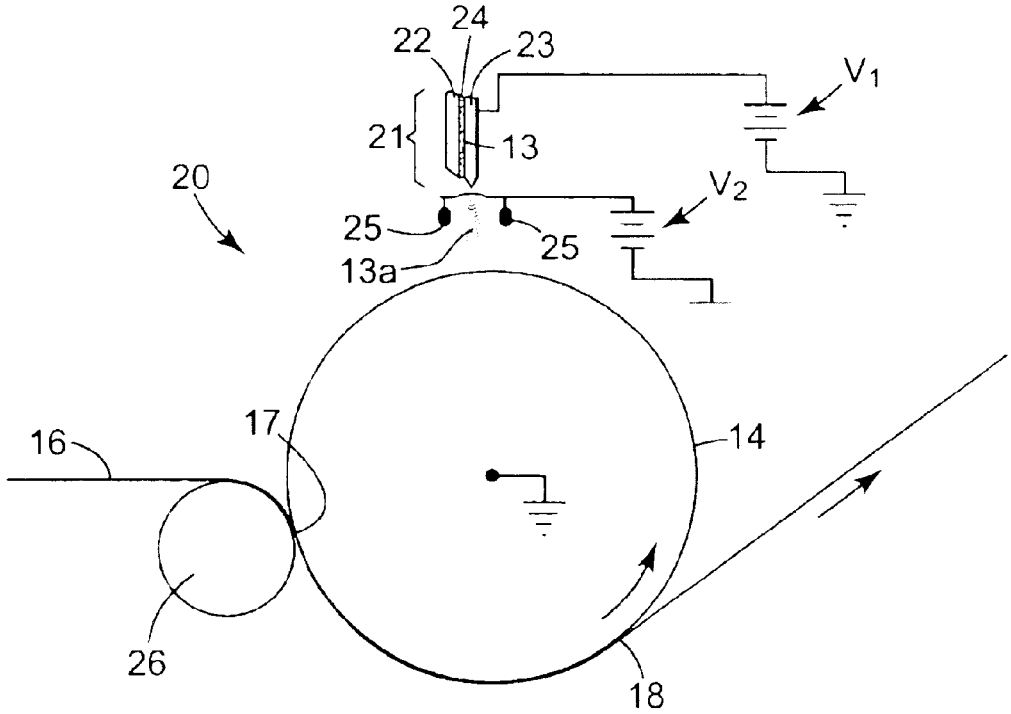
FIG. 2 is a schematic side view of an apparatus of the invention equipped with a nip roll.

FIG. 2 shows an electrostatic spray coating apparatus 20 including electrostatic spray head 21 for dispensing a mist 13*a* of coating liquid 13 onto rotating grounded drum 14. Spray head 21 includes plate 22 and blade 23, between which lies slot 24 and below which lie field adjusting electrodes 25. Liquid 13 is supplied to the top of slot 24 and exits spray head 21 as atomized drops. A first voltage $V_1$ between spray head 21 and drum 14 creates an electric field that helps atomize the drops and urge them toward drum 14. An optional second voltage $V_2$ between electrodes 25 and drum 14 creates an additional electric field that helps urge the drops toward drum 14. If desired, second voltage $V_2$ can be omitted and electrodes 25 can be grounded. Nip roll 26 forces moving web 16 against drum 14 at entry point 17. The nip pressure helps to spread and coalesce the drops into a void-free coating prior to separation point 18. Due to the nip pressure, the coating will tend to be more uniform and to coalesce more rapidly than is the case for the method and apparatus shown in FIG. 1.

Many criteria can be applied to measure coating uniformity improvement. Examples include caliper standard deviation, ratio of minimum (or maximum) caliper divided by average caliper, range (which we define as the maximum caliper minus the minimum caliper over time at a fixed observation point), and reduction in void area. For example, preferred embodiments of our invention provide range reductions of greater than 75% or even greater than 90%. For discontinuous coatings (or in other words, coatings that initially have voids), our invention enables reductions in the total void area of greater than 50%, greater than 75%, greater than 90%, greater than 99% or even complete elimination of detectable voids. Those skilled in the art will recognize that the desired degree of coating uniformity improvement will depend on many factors including the type of coating, coating equipment and coating conditions, and the intended use for the coated substrate.

Figure 3A:
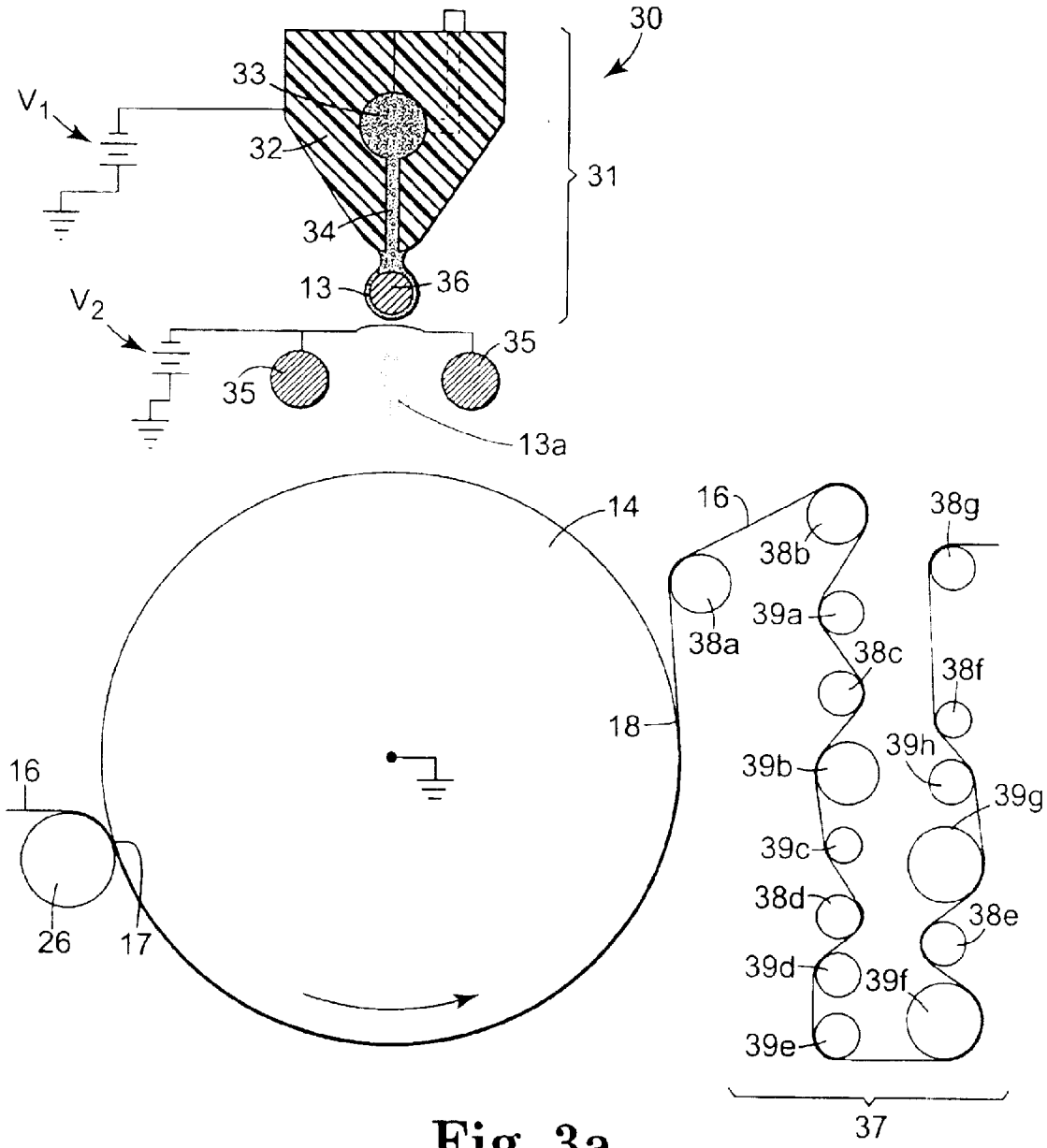
FIG. 3*a* is a schematic side view, partially in section, of an apparatus of the invention equipped with a nip roll and an improvement station.

FIG. 3*a* shows an electrostatic spray coating apparatus 30 including an electrostatic spray head 31 for dispensing a pattern of drops or mists 13*a* of coating liquid 13 onto rotating grounded drum 14. Apparatus 30 of FIG. 3*a* incorporates an improvement station 37 whose operation is described in copending U.S. patent application Ser. No. 09/757,955, filed Jan. 10, 2001) entitled COATING DEVICE AND METHOD, incorporated herein by reference. Spray head 31 is shown in U.S. Pat. No. 5,326,598, and is sometimes referred to as an "electrospray head." Spray head 31 includes die body 32 having liquid supply gallery 33 and slot 34. Liquid 13 flows through gallery 33 and slot 34, and then over wire 36, forming a thin film of liquid 13 with a substantially constant radius of curvature around wire 36. A first voltage $V_1$ between spray head 31 and drum 14 creates an electric field that helps atomize the liquid 13 and urge the atomized drops of mist 13*a* toward drum 14. An optional second voltage $V_2$ between electrodes 35 and drum 14 creates an additional electric field that helps urge the drops toward drum 14. If desired, second voltage $V_2$ can be omitted and electrodes 35 can be grounded. When voltage $V_1$ is applied, liquid 13 forms a series of spaced liquid filaments (not shown in FIG. 3*a*) that break apart into mists 13*a* extending downward from wire 36. For a given applied voltage, the filaments are spatially and temporally fixed along wire 36. The mists 13*a* contain highly charged drops that land on rotating drum 14. Nip roll 26 forces moving web 16 against drum 14 at entry point 17. The nip pressure helps to spread and coalesce the drops that have already landed on drum 14 into a void-free coating prior to separation point 18. Web 16 then travels thorough an 8-roll improvement station 37 having idler rolls 38*a* through 38*g* and unequal diameter pick-and-place rolls 39*a* through 39*h*. While in the improvement station, the wet side of web 16 contacts the wet surfaces of pick-and-place rolls 39*a* through 39*h*, whereupon the coating becomes more uniform in the down-web direction as will be explained in more detail below. The apparatus and method shown in FIG. 3*a* is especially useful for forming very thin coatings with high down web uniformity.

Figure 3B:
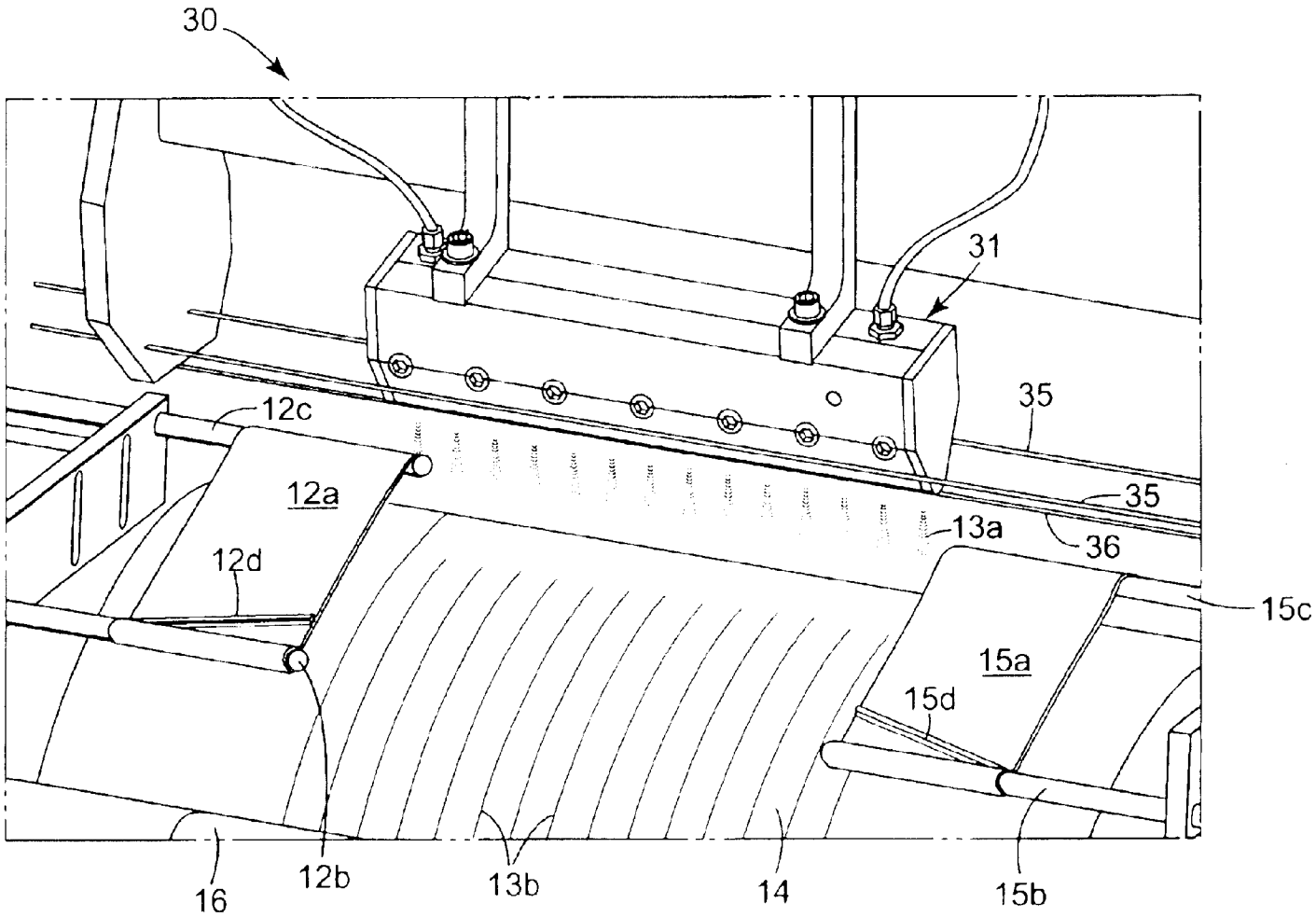
FIG. 3*b* is a perspective view of the electrostatic spray head and conductive transfer surface of the apparatus of FIG. 3*a*.

FIG. 3*b* shows a perspective view of electrostatic spray head 31 and drum 14 of FIG. 3*a* from the upweb side of apparatus 30. Side pan 12*a* is mounted on sliding rods 12*b* and 12*c*, and side pan 15*a* is mounted on sliding rods 15*b* and 15*c*. Side pans 12a and 15*a* can be moved together or apart to control coating width. Liquid mists 13*a* extend below wire 36. Excess coating liquid is ducted away by dams 12*d* and 15*d*. If needed, sliding rods, 12*b*, 12*c*, 15*b* and 15*c* can be moved towards each other until they touch and then further pans of varying widths can be added along the rods to produce striped down-web coating patterns.

Figure 3C:
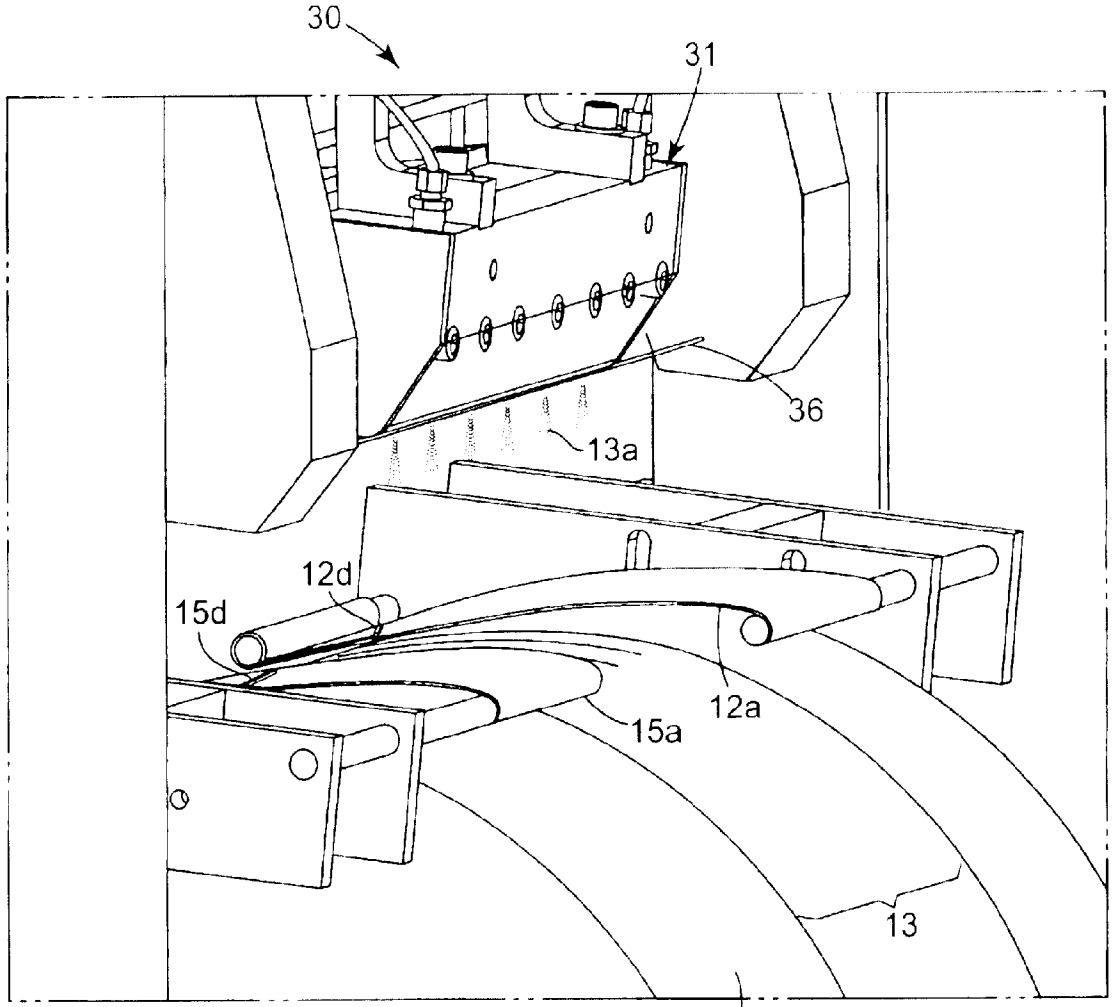
FIG. 3*c* is another perspective view of the electrostatic spray head and conductive transfer surface of the apparatus of FIG. 3*a*.

FIG. 3*c* shows a perspective view of the electrostatic spray head 31 and drum 14 of FIG. 3*a* from the downweb side of apparatus 30. Electrodes 35 have been omitted for clarity. A central stripe on drum 14 is wet with coating liquid 13. Liquid mists 13*a* extend below wire 36, but there are fewer filaments per unit of length along wire 36 than in FIG. 3*b* (and thus fewer mists 13*a*), because the voltage $V_1$ has been reduced in FIG. 3*c*.

Due to the spacing between mists 13*a*, there is a tendency for the drops that land on drum 14 to form regions of high and low coating caliper across drum 14. For thin film coatings the low regions can sometimes be seen as faint stripes 13*b* such as are shown in FIG. 3*b*. After passing nip roll 26 and separation point 18 the stripes are less prominent on the portion of drum 14 between separation point 18 and the target region for the mists 13*a*, as best seen in FIG. 3*c*.

The presence of low caliper regions can be further discouraged and the cross-web uniformity of the coating on the transfer surface and target substrate can be further improved by changing the drop pattern position with respect to the rotating transfer surface during spraying using, for example, mechanical motion or vibration of the electrostatic spray head or heads as in U.S. Pat. Nos. 2,733,171, 2,893,894 and 5,049,404; a change in the distance between the electrostatic spray head or heads and the substrate; or alteration of the electrostatic field as described in U.S. Pat. No. 6,579,574 entitled VARIABLE ELECTROSTATIC SPRAY COATING APPARATUS AND METHOD, incorporated herein by reference.

Figure 4A:
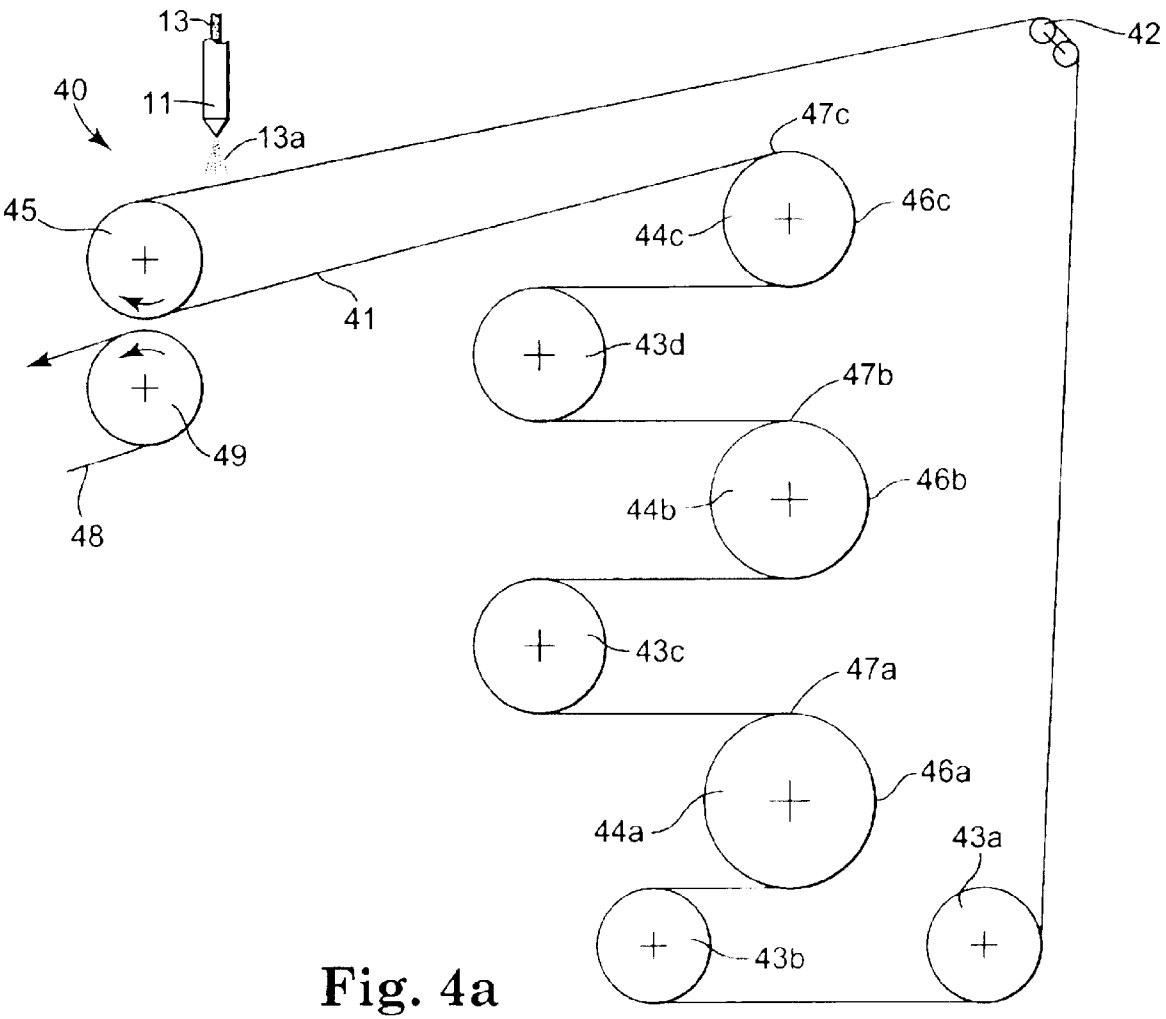
FIG. 4*a* is a schematic side view of an apparatus of the invention equipped with a conductive transfer belt.

FIG. 4*a* shows a coating apparatus of the invention 40 employing electrostatic spray head 11 for dispensing a mist 13*a* of coating liquid 13 onto circulating grounded conductive transfer belt 41. Apparatus 40 utilizes an improvement station to circulate and substantially uniformly coat the conductive transfer surface. Belt 41 (which is made of a conductive material such as a metal band) circulates on steering unit 42; idlers 43*a*, 43*b*, 43*c* and 43*d*; unequal diameter pick-and-place rolls 44*a*, 44*b* and 44*c*; and back-up roll 45. Target web 48 is driven by powered roll 49 and can be brought into contact with belt 41 as belt 41 circulates around back-up roll 45. Pick-and-place rolls 44*a*, 44*b* and 44*c* are undriven and thus co-rotate with belt 41, and have respective relative diameters of, for example, 1.36, 1.26 and 1. The coating on belt 41 contacts the surfaces of pick-and-place rolls 44*a*, 44*b* and 44*c* at the liquid-filled nip regions 46*a*, 46*b* and 46*c*. The liquid coating splits at the separation points 47*a*, 47*b* and 47*c*, and a portion of the coating remains on the pick-and-place rolls 44*a*, 44*b* and 44*c* as they rotate away from the separation points 47*a*, 47*b* and 47*c*. The remainder of the coating travels onward with belt 41. Down-web variations in the coating caliper just prior to the separation points 47*a*, 47*b* and 47*c* will be mirrored in both the liquid caliper variation on belt 41 and on the surfaces of the pick-and-place rolls 44*a*, 44*b* and 44*c* as they leave separation points 47*a*, 47*b* and 47*c*. Following further movement of belt 41, the liquid on the pick-and-place rolls 44*a*, 44*b* and 44*c* will be redeposited on belt 41 in new positions along belt 41.

Following startup of apparatus 40 and a few rotations of belt 41, belt 41 and the surfaces of rolls 44i a, 44*b* and 44*c* will become coated with a substantially uniform wet layer of liquid 13. Once belt 41 is coated with liquid, there will no longer be a three phase (air, coating liquid and belt) wetting line at the region in which the applied atomized drops of coating liquid 13 reach belt 41. This makes application of the coating liquid 13 much easier than is the case for direct coating of a dry web.

When rolls 45 and 49 are nipped together, a portion of the wet coating on belt 41 is transferred to target web 48. Since only about one half the liquid is transferred at the 45, 49 roll nip, the percentage of caliper non-uniformity on belt 41 in the region immediately downstream from the spray head 11 will generally be much smaller (e.g., by as much as much as half an order of magnitude) than when coating a dry web without a transfer belt and without passing the thus-coated web through an improvement station having the same number of rolls. In steady state operation coating liquid 13 is added to belt 41 by spray head 11 at the same average rate that the coating is transferred to target web 48.

Although a speed differential can be employed between belt 41 and any of the other rolls shown in FIG. 4*a*, or between belt 41 and web 48, we prefer that no speed differential be employed between belt 41 and pick-and-place rolls 44*a*, 44*b* and 44*c*, or between belt 41 and web 48. This simplifies the mechanical construction of apparatus 40.

Figure 4B:
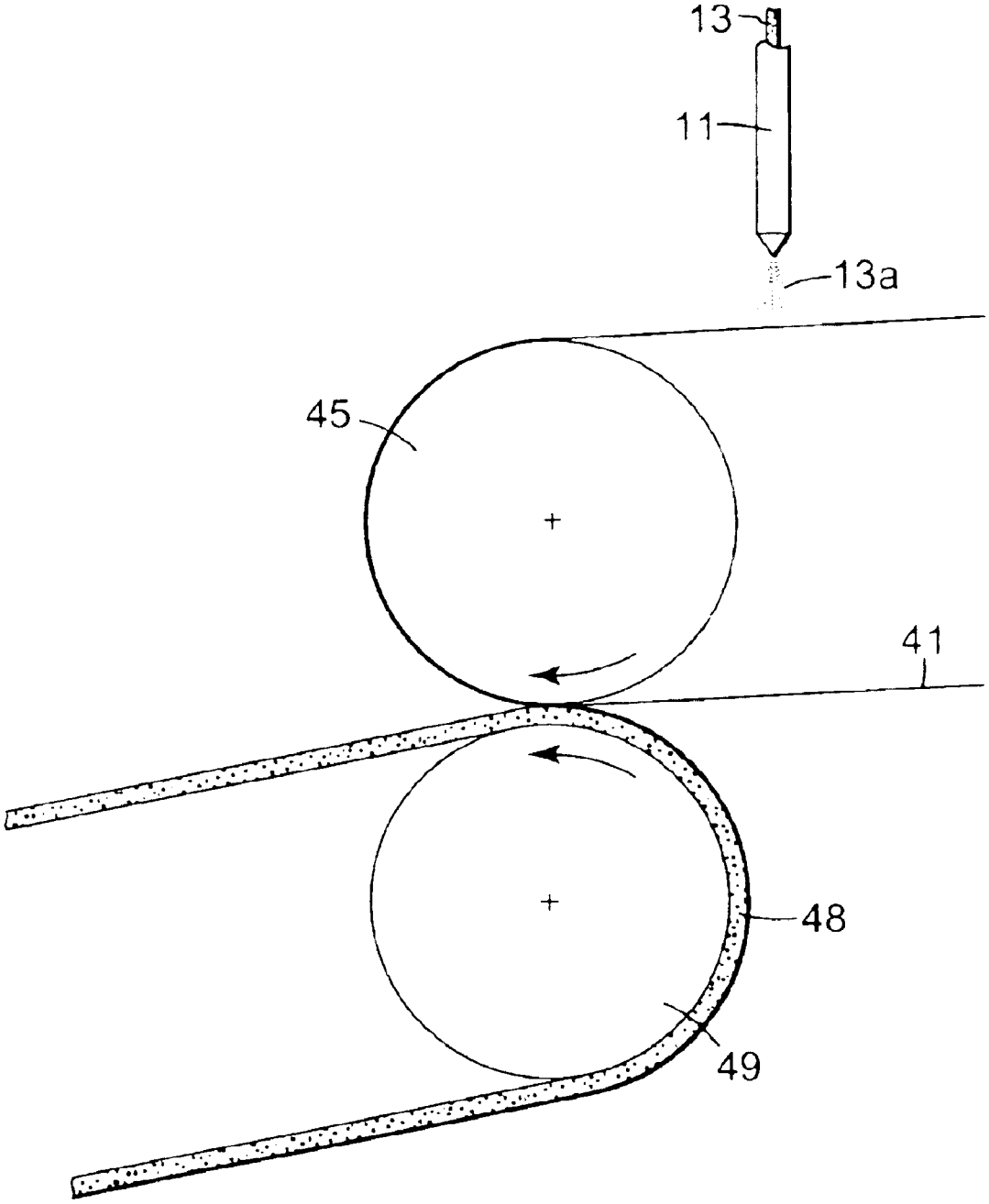
FIG. 4*b* is a magnified side view of a portion of the apparatus of FIG. 4*a* and a porous web.

FIG. 4*b* shows a magnified view of rolls 45 and 49 of FIG. 4*a*. As illustrated in FIG. 4*b*, target web 48 is porous. Target web 48 can also be non-porous if desired. Through suitable adjustment of the nip pressure, penetration of the wet coating into the pores of a porous target web can be controlled and limited to the upper surface of the porous web, without penetration to the other surface of the web and preferably without penetration to the inner portion of the web. In contrast, when conventional electrostatic or other spray coating techniques are used for direct coating of a porous web, the applied atomized drops frequently penetrate into and sometimes completely through the pores of the web. This is especially true for woven webs with a large weave pattern or for nonwoven webs with a substantial void volume.

Figure 5A:
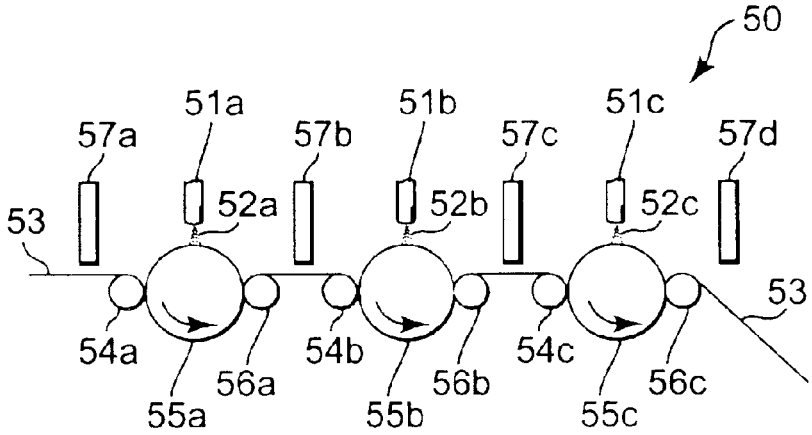
FIG. 5*a* is a schematic side view of an apparatus of the invention equipped with a series of electrostatic spray heads and conductive drums.
Figure 5B:
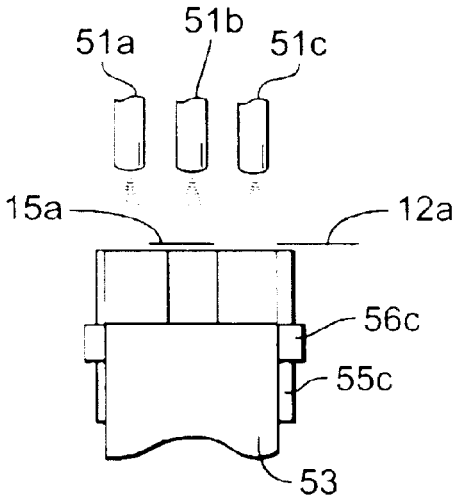
FIG. 5*b* is a schematic end view of the apparatus of FIG. 5*a*, set up to spray coating stripes in adjacent lanes.

FIG. 5*a* and FIG. 5*b* respectively show side and end schematic views of an apparatus 50 of the invention that can apply stripes of coatings to a web in adjacent, overlapping or separate lanes. A series of electrostatic spray heads 51*a*, 51*b* and 51*c* apply mists 52*a*, 52*b* and 52*c* of liquids to web 53, at positions that are spaced laterally across the width of web 53. Web 53 passes over nip rolls 54*a*, 54*b* and 54*c*, under rotating conductive drums 55*a*, 55*b* and 55*c*, and over take-off rolls 56*a*, 56*b* and 56*c*. Ground plates 57*a*, 57*b*, 57*c* and 57*d* help discourage electrostatic interference between the electrostatic spray heads 51*a*, 51*b* and 51*c*. Drum 55*b* serves as an improvement station roll for the coating applied at drum 55*a*, and drum 55*c* serves as an improvement station roll for the coatings applied at drums 55*a* and 55*b*.

As shown in FIG. 5*b*, electrostatic spray heads 51*a*, 51*b* and 51*c* have been set up to apply stripes of the coatings in lanes. Those skilled in the art will appreciate that electrostatic spray heads 51*a*, 51*b* and 51*c* can be spaced at other lateral positions and that side pans or other masking devices such as side pans 12*a* and 15*a* (for clarity, only one of each is shown in FIG. 5*b*) over drum 55*c* can be employed and adjusted to control the lateral positions and widths of each coating stripe. Thus the coating stripes can wholly or partially overlap, abut one another, or be separated by stripes of uncoated web as desired. Those skilled in the art will also appreciate that electrostatic spray heads 51*a*, 51*b* and 51*c* can contain different coating chemistries, so that several different chemistries can be contemporaneously coated across web 53.

Figure 5C:
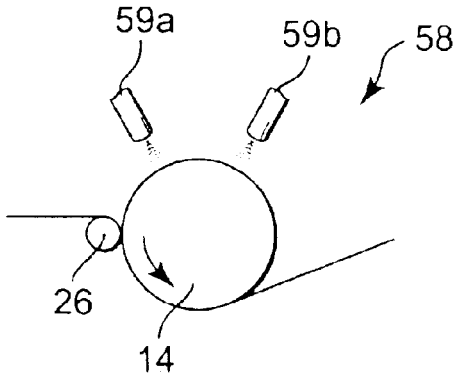
FIG. 5*c* is a schematic side view of an apparatus of the invention equipped with a series of electrostatic spray heads and a single conductive drum.

FIG. 5*c* shows a side schematic view of an apparatus 58 of the invention that can apply stripes of the coatings in lanes, using a single rotating conductive drum 14 or other transfer surface and a plurality of electrostatic spray heads 59*a* and 59*b*. As with apparatus 50 of FIG. 5*a* and FIG. 5*b*, electrostatic spray heads 59*a* and 59*b* of apparatus 58 can be spaced at various lateral positions and side pans or other masking devices can be employed and adjusted to control the lateral positions and widths of each coating stripe. Thus the coating stripes produced by apparatus 58 can wholly or partially overlap, abut one another, or be separated by stripes of uncoated web as desired.

Two or more spray heads can be positioned over the transfer surface (e.g., over the drum 14 in FIG. 5*c*) and arranged to deposit two or more liquids into the same lane. This will enable mixing and application of unique compositional variations or layered coatings. For example, some solventless silicone formulations employ two immiscible chemicals. These may include two different acrylated polysiloxanes that will turn cloudy when mixed, and will separate into two or more phases if allowed to stand undisturbed for a sufficient period of time. Also, many epoxy-silicone polymer precursors and other polymerizable formulations contain a liquid catalyst component that is immiscible with the rest of the formulation. By spraying these formulation components sequentially from successive nozzles, we can manipulate the manner in which the components are blended and the downweb component concentrations and thicknesses. Through the combined use of sequentially arranged spray heads followed by passage of the applied coating through an improvement station, we can achieve repeated separation and recombining of the components. This is especially useful for difficult to mix or rapid reaction formulations.

If desired, an inert or a non-inert atmosphere can be used to prevent or to encourage a reaction by the drops as they travel from the spray head or spray heads to the substrate or transfer surface. Also, the substrate or transfer surface can be heated or cooled to encourage or to discourage a reaction by the applied liquid.

Figure 6:
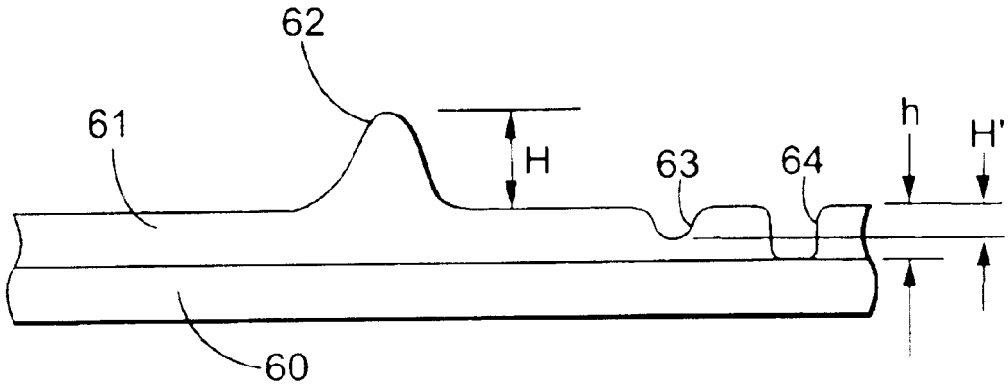
FIG. 6 is a schematic side view of coating defects on a web.

As mentioned above, the method and apparatus of the invention preferably employ an improvement station comprising two or more pick-and-place devices that improve the uniformity of the coating. The improvement station is described in the above-mentioned copending U.S. patent application Ser. No. 09/757,955 and can be further explained as follows. Referring to FIG. 6, a coating of liquid 61 of nominal caliper or thickness h is present on a substrate (in this instance, a continuous web) 60. If a random local spike 62 of height H above the nominal caliper is deposited for any reason, or if a random local depression (such as partial cavity 63 of depth H' below the nominal caliper, or void 64 of depth h) arises for any reason, then a small length of the coated substrate will be defective and not useable. The improvement station brings the coating-wetted surfaces of two or more pick-and-place improvement devices (not shown in FIG. 6) into periodic (e.g., cyclic) contact with coating 61. This permits uneven portions of the coating such as spike 62 to be picked off and placed at other positions on the substrate, or permits coating material to be placed in uneven portions of the coating such as cavity 63 or void 64. The placement periods of the pick-and-place devices are chosen so that their actions do not reinforce coating defects along the substrate. The pick-and-place devices can if desired be brought into contact with the coating only upon appearance of a defect. Alternatively, the pick-and-place devices can contact the coating whether or not a defect is present at the point of contact.

Figure 7:
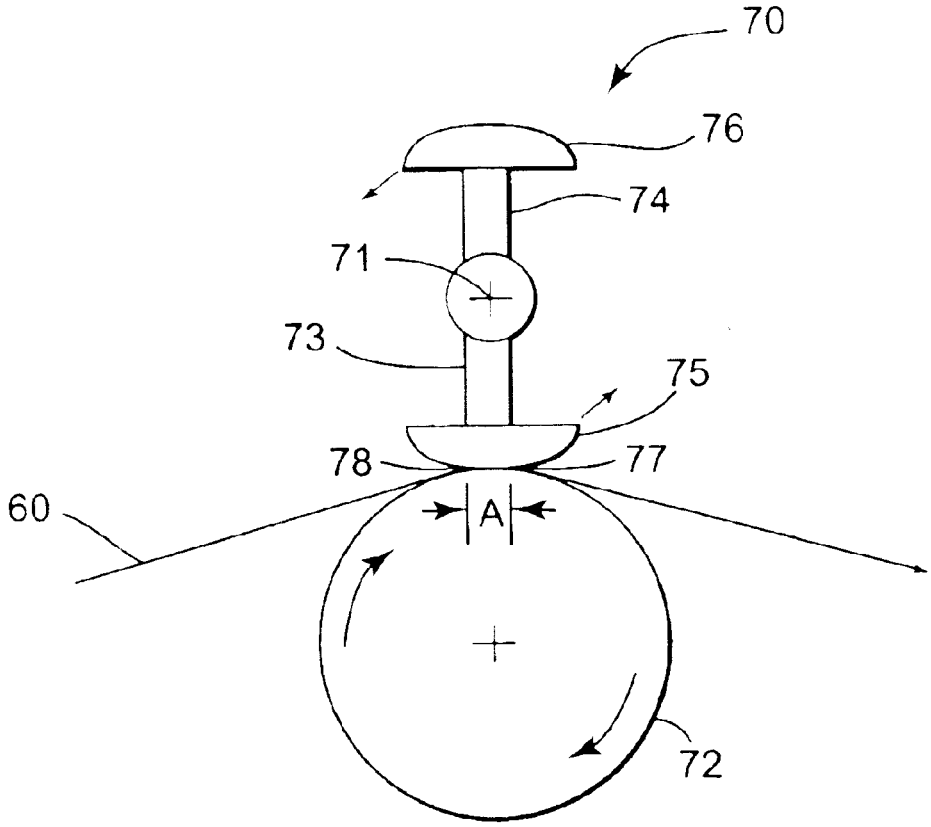
FIG. 7 is a schematic side view of a pick-and-place device.

A type of pick-and-place device 70 that can be used in the present invention to improve a coating on a moving web 60 is shown in FIG. 7. Device 70 has a central hub 71 about which device 70 can rotate. The device 70 extends across the coated width of the moving web 60, which is transported past device 70 on roll 72. Extending from hub 71 are two radial arms 73 and 74 to which are attached pick-and-place surfaces 75 and 76. Surfaces 75 and 76 are curved to produce a singular circular arc in space when device 70 rotates. Because of their rotation and spatial relation to the web 60, pick-and-place surfaces 75 and 76 periodically contact web 60 opposite roll 72. Wet coating (not shown in FIG. 7) on web 60 and surfaces 75 and 76 fills a contact zone of width A on web 60 from starting point 78 to separation point 77. At the separation point, some liquid stays on both web 60 and surface 75 as the pick-and-place device 70 continues to rotate and web 60 translates over roll 72. Upon completing one revolution, surface 75 places a portion of the liquid at a new longitudinal position on web 60. Web 60 meanwhile will have translated a distance equal to the web speed multiplied by the time required for one rotation of the pick-and-place surface 75. In this manner, a portion of a liquid coating can be picked up from one web position and placed down on a web at another position and at another time. Both the pick-and-place surfaces 75 and 76 produce this action.

The period of a pick-and-place device can be expressed in terms of the time required for the device to pick up a portion of wet coating from one position along a substrate and then lay it down on another position, or by the distance along the substrate between two consecutive contacts by a surface portion of the device. For example, if the device 70 shown in FIG. 7 is rotated at 60 rpm and the relative motion of the substrate with respect to the device remains constant, then the period is one second.

A plurality of pick and place devices having two or more, and more preferably three or more different periods, are employed. Most preferably, pairs of such periods are not related as integer multiples of one another. The period of a pick-and-place device can be altered in many ways. For example, the period can be altered by changing the diameter of a rotating device; by changing the speed of a rotating or oscillating device; by repeatedly (e.g., continuously) translating the device along the length of the substrate (e.g., up web or down web) with respect to its initial spatial position as seen by a fixed observer; or by changing the translational speed of the substrate relative to the speed of rotation of a rotating device. The period does not need to be a smoothly varying function, and does not need to remain constant over time.

Many different mechanisms can produce a periodic contact with the liquid coated substrate, and pick-and-place devices having many different shapes and configurations can be employed. For example, a reciprocating mechanism (e.g., one that moves up and down) can be used to cause the coating-wetted surfaces of a pick-and-place device to oscillate into and out of contact with the substrate. Preferably the pick-and-place devices rotate, as it is easy to impart a rotational motion to the devices and to support the devices using bearings or other suitable carriers that are relatively resistant to mechanical wear.

Although the pick-and-place device shown in FIG. 7 has a dumbbell shape and two noncontiguous contacting surfaces, the pick-and-place device can have other shapes, and need not have noncontiguous contacting surfaces. Thus as already shown in FIG. 3*a* and FIG. 4*a*, the pick-and-place devices can be a series of rolls that contact the substrate, or an endless belt whose wet side contacts a series of wet rolls and the substrate, or a series of belts whose wet sides contact the substrate, or combinations of these. These rotating pick-and-place devices preferably remain in continuous contact with the substrate.

Improvement stations employing rotating rolls are preferred for coating moving webs or other substrates having a direction of motion. The rolls can rotate at the same peripheral speed as the moving substrate, or at a lesser or greater speed. If desired, the devices can rotate in a direction opposite to that of the moving substrate. Preferably, at least two of the rotating pick-and-place devices have the same direction of rotation and are not periodically related. More preferably, for applications involving the improvement of a coating on a web or other substrate having a direction of motion, the direction of rotation of at least two such pick-and-place devices is the same as the direction of substrate motion. Most preferably, such pick-and-place devices rotate in the same direction as and at substantially the same speed as the substrate. This can conveniently be accomplished by using corotating undriven rolls that bear against the substrate and are carried with the substrate in its motion.

When initially contacting the coating with a pick-and-place device like that shown in FIG. 7, a length of defective material is produced. At the start, the pick-and-place transfer surfaces 75 and 76 are dry. At the first contact, device 70 contacts web 60 at a first position on web 60 over a region A. At the separation point 77, roughly half the liquid that entered region A at the starting point 78 will wet the transfer surface 75 or 76 with coating liquid and be removed from the web. This liquid splitting creates a spot of low and defective coating caliper on web 60 even if the entering coating caliper was uniform and equal to the desired average caliper. When the transfer surface 75 or 76 re-contacts web 60 at a second position, a second coating liquid contact and separation occurs, and a second defective region is created. However, it will be less deficient in coating than the first defective region. Each successive contact produces smaller defective regions on the web with progressively smaller deviations from the average caliper until equilibrium is reached. Thus, the initial contacting produces periodic variations in caliper for a length of time. This represents a repeating defect, and by itself would be undesirable.

There is no guarantee that the liquid split ratio between the web and the surface will remain always at a constant value. Many factors can influence the split ratio, but these factors tend to be unpredictable. If the split ratio changes abruptly, a periodic down web caliper variation will result even if the pick-and-place device has been running for a long time. If foreign material lodges on a transfer surface of the pick-and-place device, the device may create a periodic down web defect at each contact. Thus, use of only a single pick-and-place device can potentially create large lengths of scrap material.

The improvement station employs two or more, preferably three or more, and more preferably five or more or even eight or more pick-and-place devices in order to achieve good coating uniformity. After the coating liquid on the pick-and-place transfer surfaces has built to an equilibrium value, a random high or low coating caliper spike may pass through the station. When this happens, and if the defect is contacted, then the periodic contacting of the web by a single pick-and-place device, or by an array of several pick-and-place devices having the same contact period, will repropagate a periodic down web defect in the caliper. Again, scrap will be generated and those skilled in coating would avoid such an apparatus. It is much better to have just one defect in a coated web rather than a length of web containing multiple images of the original defect. Thus a single device, or a train of devices having identical or reinforcing periods of contact, can be very detrimental. However, a random initial defect entering the station or any defect generated by the first contacting can be diminished by using an improvement station comprising more than two pick and place devices whose periods of contact are selected to reduce rather than repropagate the defect. Such an improvement station can provide improved coating uniformity rather than extended lengths of defective coating, and can diminish input defects to such an extent that the defects are no longer objectionable.

By using the above-described electrostatic spray head and an improvement station in combination, a new down web coating profile can be created at the exit from the improvement station. That is, by using multiple pick-and-place devices we can modify defects in the coating applied by the electrostatic spray head. These defects will be repropagated as defect images by the first device in the improvement station and modified by additional defect images that are propagated and repropagated from the second and any subsequent devices. We can do this in a constructively and destructively additive manner so that the net result is near uniform caliper or a controlled caliper variation. We in effect create multiple waveforms that are added together in a manner so that the constructive and destructive addition of each waveform combines to produce a desired degree of uniformity. Viewed somewhat differently, when a coating upset passes through the improvement station a portion of the coating from the high spots is in effect picked off and placed back down in the low spots.

Figure 8:
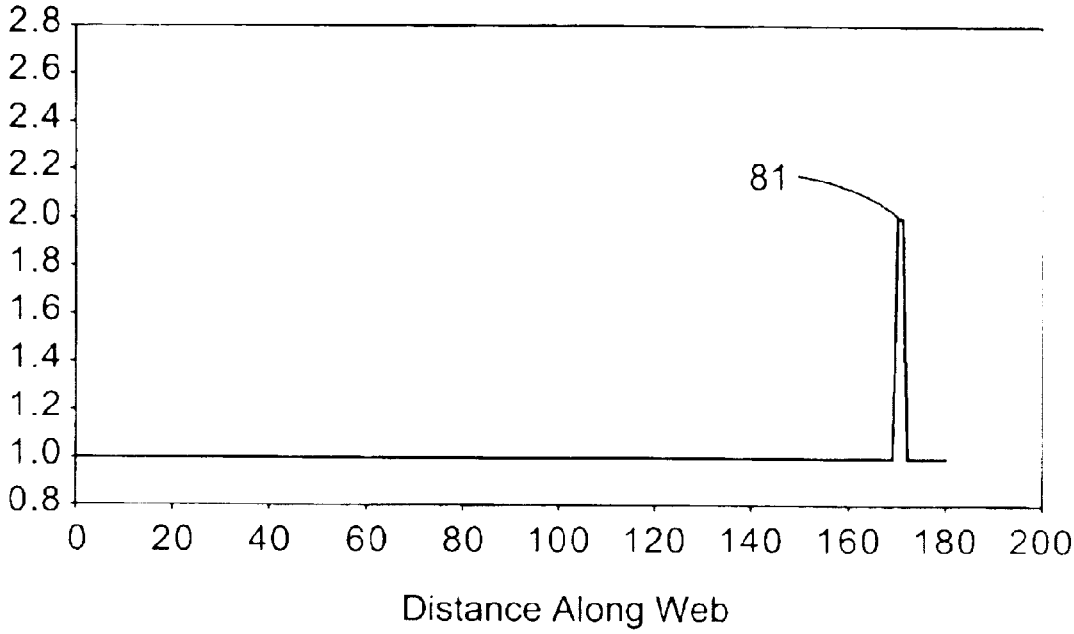
FIG. 8 is a graph of coating caliper vs. web distance for a single large caliper spike on a web.

Mathematical modeling of our improvement process is helpful in gaining insight and understanding. The modeling is based on fluid dynamics, and provides good agreement to observable results. FIG. 8 shows a graph of liquid coating caliper vs. lengthwise (machine direction) distance along a web for a solitary random spike input 81 located at a first position on the web approaching a periodic contacting pick-and-place transfer device (not shown in FIG. 8). FIG. 9 through FIG. 13 show mathematical model results illustrating the liquid coating caliper along the web when spike input 81 encounters one or more periodic pick-and-place contacting devices.

Figure 9:
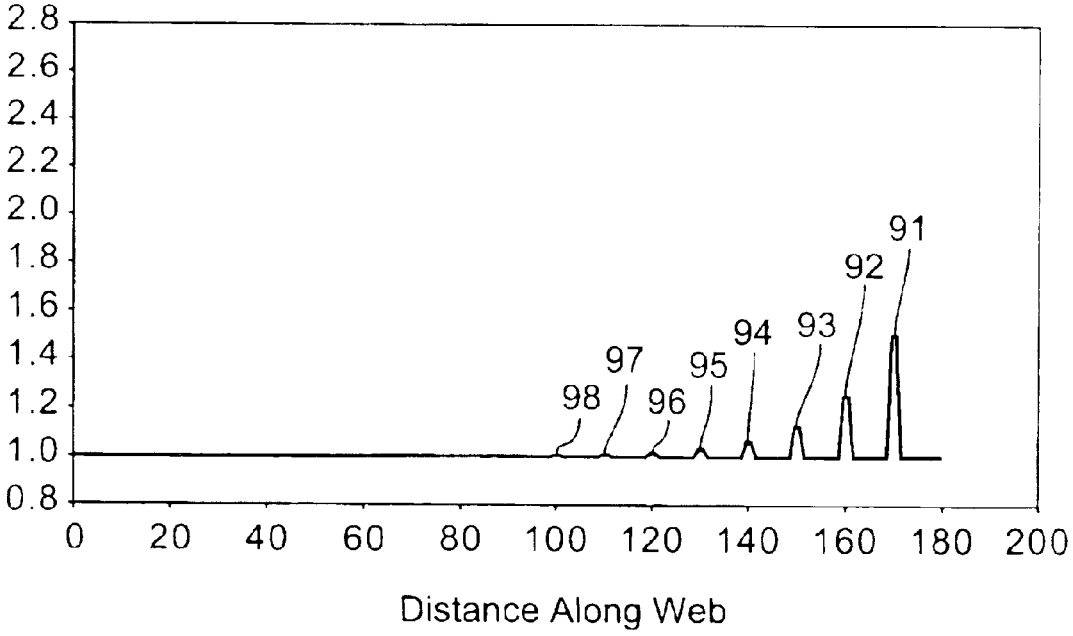
FIG. 9 is a graph of coating caliper vs. web distance when the spike of FIG. 8 encounters a single periodic pick-and-place device having a period of 10.

FIG. 9 shows the amplitude of the reduced spike 91 that remains on the web at the first position and the repropagated spikes 92, 93, 94, 95, 96, 97 and 98 that are placed on the web at second and subsequent positions when spike input 81 encounters a single periodic pick-and-place contacting device. The peak of the initial input spike 81 is one length unit long and two caliper units high. The contacting device period is equivalent to ten length units. The images of the input defect are repeated periodically in 10 length unit increments, over a length longer than sixty length units. Thus, the length of defectively coated or "reject" web is greatly increased compared to the length of the input defect. The exact defective length, of course, depends on the acceptable coating caliper variability for the desired end use.

Figure 10:
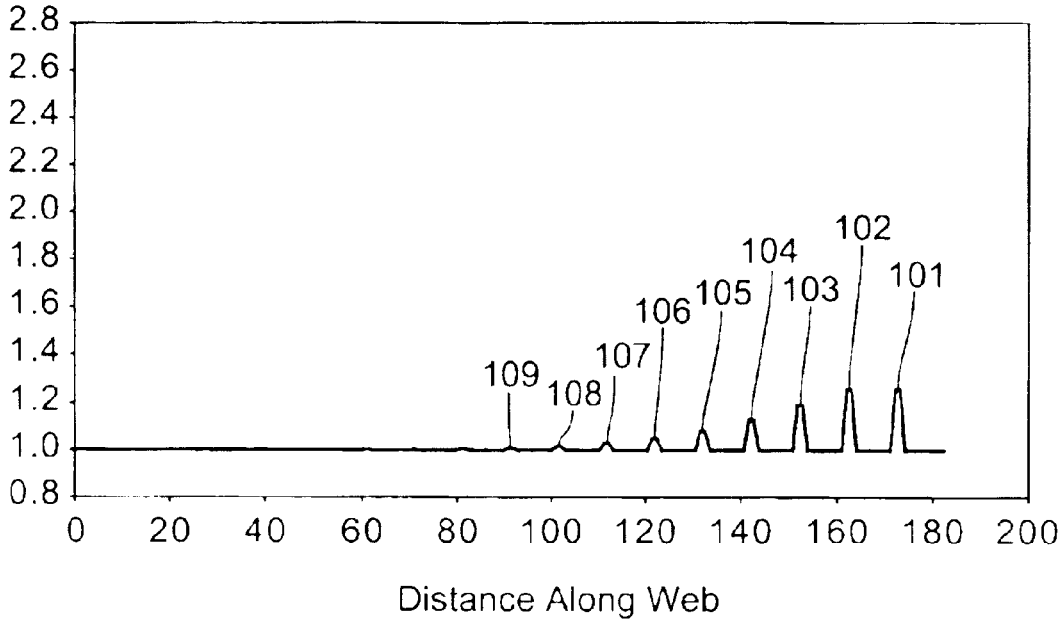
FIG. 10 is a graph of coating caliper vs. web distance when the spike of FIG. 8 encounters two periodic pick-and-place devices having a period of 10.

FIG. 10 shows the amplitude of the reduced spike 101 that remains on the web at the first position and some of the repropagated spikes 102, 103, 104, 105, 106, 107, 108 and 109 that are placed on the web at second and subsequent positions when spike input 81 encounters two periodic, sequential, synchronized pick-and-place transfer devices each having a period of 10 length units. Compared to the use of a single periodic pick-and-place device, a lower amplitude spike image occurs over a longer length of the web.

Figure 11:
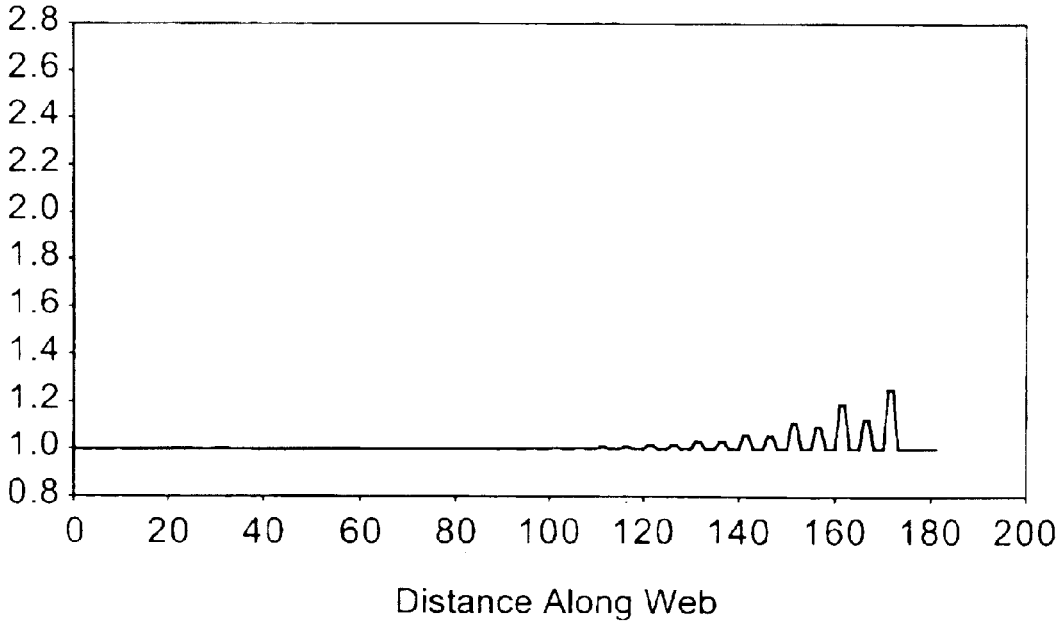
FIG. 11 is a graph of coating caliper vs. web distance when the spike of FIG. 8 encounters two periodic pick-and-place devices having periods of 10 and 5, respectively.

FIG. 11 shows the coating that results when two periodic, sequential, synchronized contacting devices having periods of 10 and then 5 are used. These devices have periodically related contacting periods. Their pick-and-place action will deposit coating at periodically related positions along the web. Compared to FIG. 10, the spike image amplitude is not greatly reduced but a somewhat shorter length of defective coated web is produced.

Figure 12:
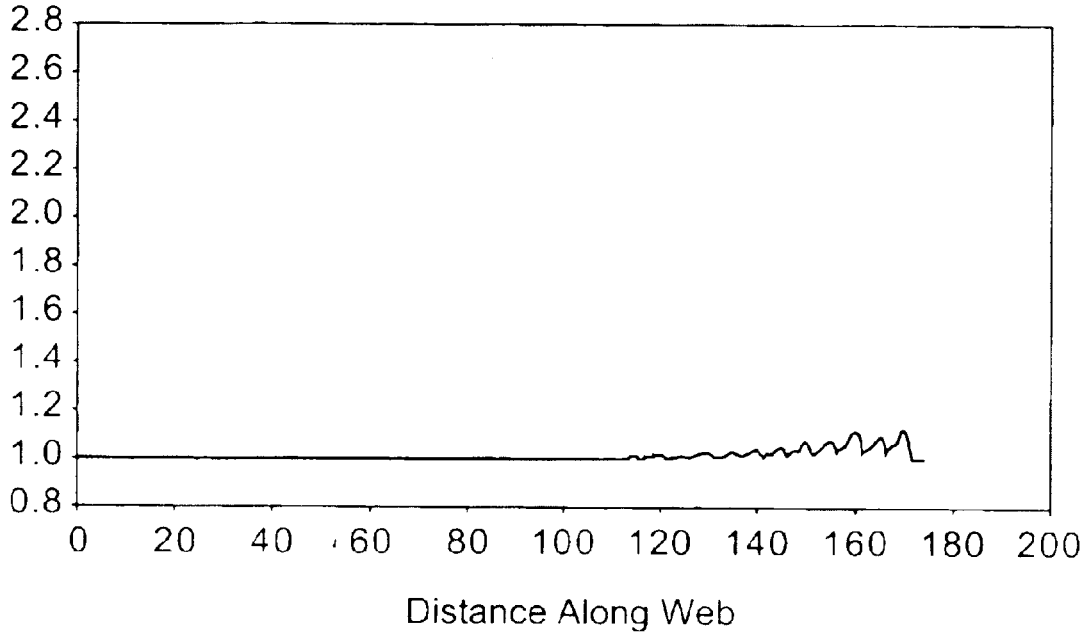
FIG. 12 is a graph of coating caliper vs. web distance when the spike of FIG. 8 encounters three periodic pick-and-place devices having periods of 10, 5 and 2, respectively.

FIG. 12 shows the coating that results when three periodic pick-and-place devices having different periods of 10, 5 and 2 are used. The device with a period of 10 and the device with a period of 5 are periodically related. The device with a period of 10 and the device with a period of 2 are also periodically related. However, the device with a period of 5 and the device with a period of 2 are not periodically related (because 5 is not an integer multiple of 2), and thus this train of devices includes first and second periodic pick-and-place devices that can contact the coating at a first position on the web and then re-contact the coating at second and third positions on the web that are not periodically related to one another with respect to their distance from the first position. Compared to the devices whose actions are shown in FIG. 9 through FIG. 11, much lower caliper deviations and much shorter lengths of defective coated web are produced.

Figure 13:
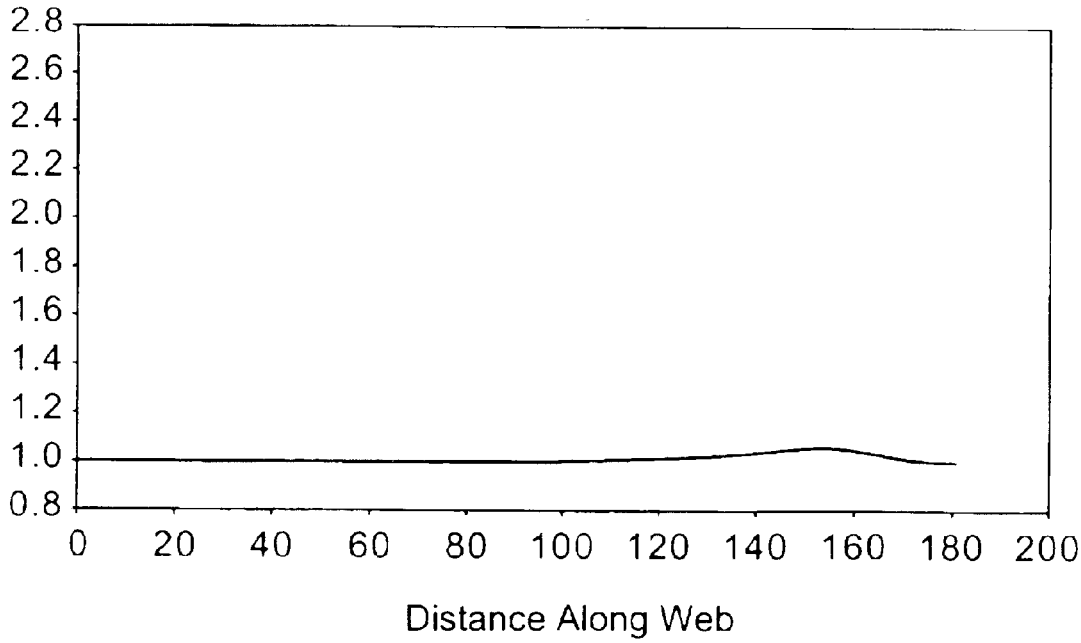
FIG. 13 is a graph of coating caliper vs. web distance when the spike of FIG. 8 encounters one periodic pick-and-place device having a period of 10 followed by one device having a period of 5 and six devices having a period of 2.

FIG. 13 shows the results for a train of eight contacting devices where the first device has a period of 10, the second device has a period of 5, and the third through eighth devices have a period of 2. Compared to the devices whose actions are shown in FIG. 9 through FIG. 11, the spike image amplitude is further reduced and a significant improvement in coating caliper uniformity is obtained.

Similar coating improvement results are obtained when the random defect is a depression (e.g., an uncoated void) rather than a spike.

The random spike and depression defects discussed above are one general class of defect that may be presented to the improvement station. The second important class of defect is a periodically repeating defect. Of course, in manufacturing coating facilities it is common to have both classes occurring simultaneously. If a periodic train of high or low coating spikes or depressions is present on a continuously running web, the coating equipment operators usually seek the cause of the defect and try to eliminate it. A single periodic pick-and-place device as illustrated in FIG. 7 may not help and may even further deteriorate the quality of the coating. However, intermittent periodic contacting of the coating by devices similar in function to that exemplified in FIG. 7 produces an improvement in coating uniformity when more than two devices are employed and when the device periods are properly chosen. Improvements are found for both random and continuous, periodic variations and combinations of the two. In general, better results will be obtained when an effort is made to adjust the relative timing of the contacts by individual devices, so that undesirable additive effects can be avoided. The use of rolls running in continuous contact with the coating avoids this complication and provides a somewhat simpler and preferred solution. Because every increment of a roll surface running on a web periodically contacts the web, a roll surface can be considered to be a series of connected intermittent periodic contacting surfaces. Similarly, a rotating endless belt can perform the same function as a roll. If desired, a belt in the form of a Mobius strip can be employed. Those skilled in the art of coating will recognize that other devices such as elliptical rolls or brushes can be adapted to serve as periodic pick-and-place devices in the improvement station. Exact periodicity of the devices is not required. Mere repeating contact may suffice.

Figure 14:
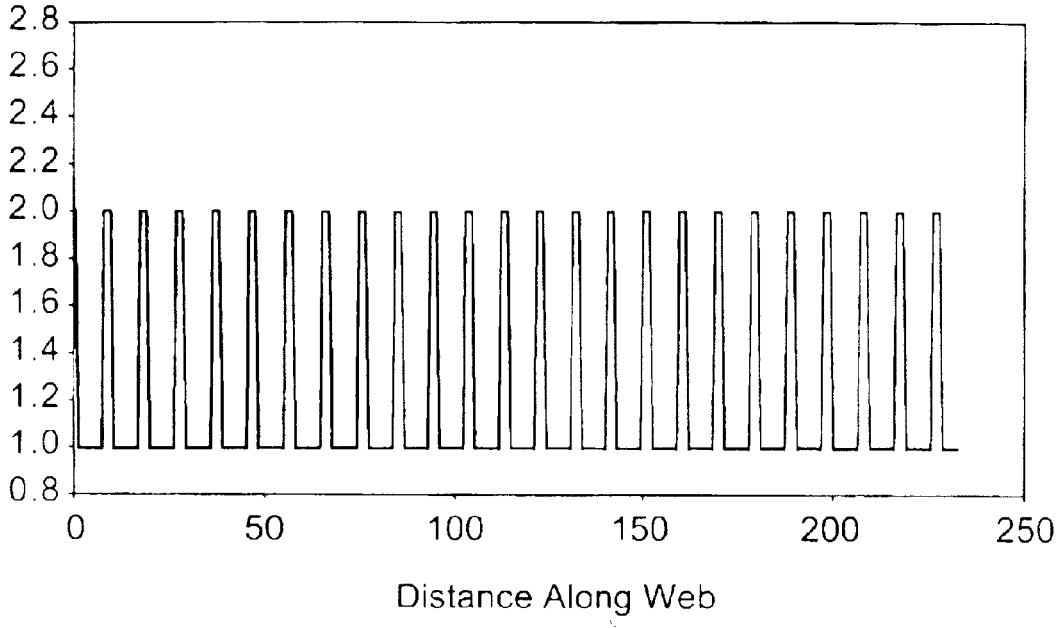
FIG. 14 is a graph of coating caliper vs. web distance for a repeating spike defect having a period of 10.
Figure 15:
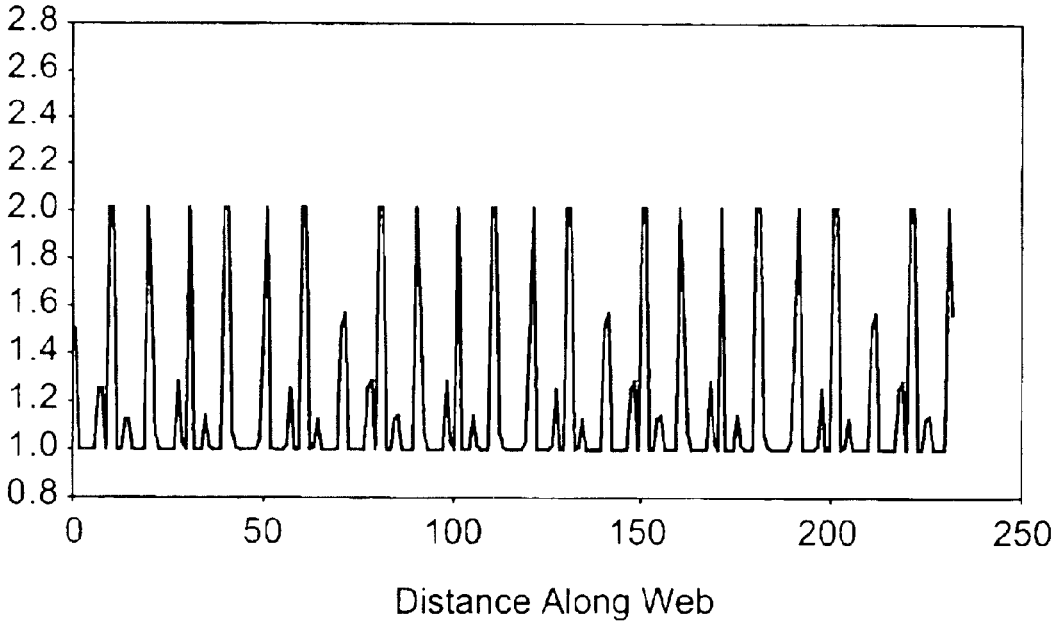
FIG. 15 is a graph of coating caliper vs. web distance when the spikes of FIG. 14 encounter a periodic pick-and-place device having a period of 7.

FIG. 14 shows a graph of liquid coating caliper vs. distance along a web for a succession of equal amplitude repeating spike inputs approaching a periodic contacting pick-and-place transfer device. If a pick-and-place device periodically and synchronously contacts this repeating defect and if the period equals the defect period, there is no change produced by the device after the initial start-up. This is also true if the period of the device is some integer multiple of the defect period. Simulation of the contacting process shows that a single device will produce more defective spikes if the period is shorter than the input defect period. FIG. 15 shows this result when a repeating defect having a period of 10 encounters a periodic pick-and-place roll device having a period of 7.

Figure 16:
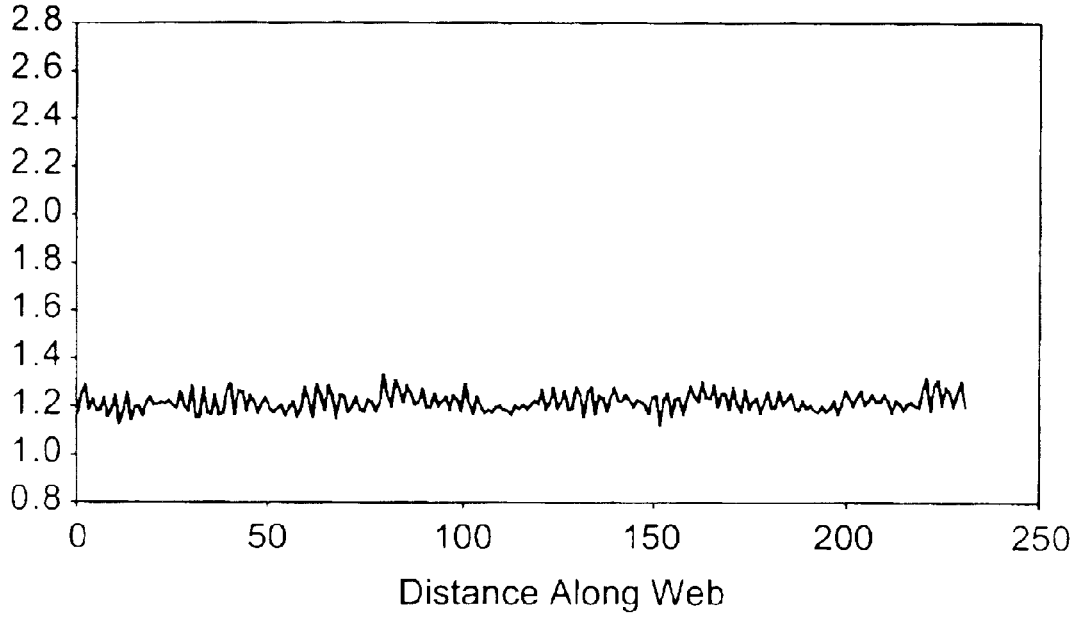
FIG. 16 is a graph of coating caliper vs. web distance when the spikes of FIG. 14 encounter a train of seven periodic pick-and-place devices having periods of 7, 5, 4, 8, 3, 3 and 3, respectively.
Figure 17:
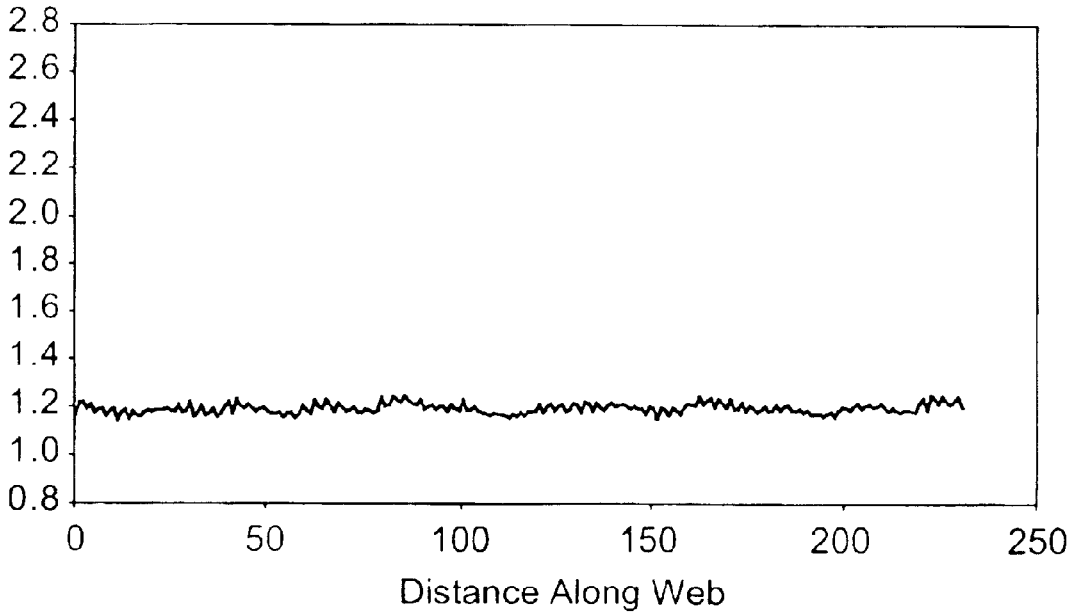
FIG. 17 is a graph of coating caliper vs. web distance when the spikes of FIG. 14 encounter a train of eight periodic pick-and-place devices having periods of 7, 5, 4, 8, 3, 3, 3 and 2, respectively.

By using multiple devices and properly selecting their periods of contact, we can substantially improve the quality of even a grossly non-uniform input coating. FIG. 16 and FIG. 17 show the simulation results when coatings having the defect pattern shown in FIG. 14 were exposed to trains of seven or eight periodic pick-and-place roll devices having periods that were not all related to one another. In FIG. 16, the devices had periods of 7, 5, 4, 8, 3, 3 and 3. In FIG. 17, the devices had periods of 7, 5, 4, 8, 3, 3, 3 and 2. In both cases, the amplitude of the highest spikes diminished by greater than 75%. Thus even though the number of spikes increased, overall a significant improvement in coating caliper uniformity was obtained.

Factors such as drying, curing, gellation, crystallization or a phase change occurring with the passage of time can impose limitations on the number of rolls employed. If the coating liquid contains a volatile component, the time necessary to translate through many rolls may allow drying to proceed to the extent that the liquid may solidify. Drying is actually accelerated by the improvement station, as is explained in more detail below. In any event, if a coating phase change occurs on the rolls for any reason during operation of the improvement station, this will usually lead to disruptions and patterns in the coating on the web. Therefore, in general we prefer to produce the desired degree of coating uniformity using as few rolls as possible.

Figure 18:
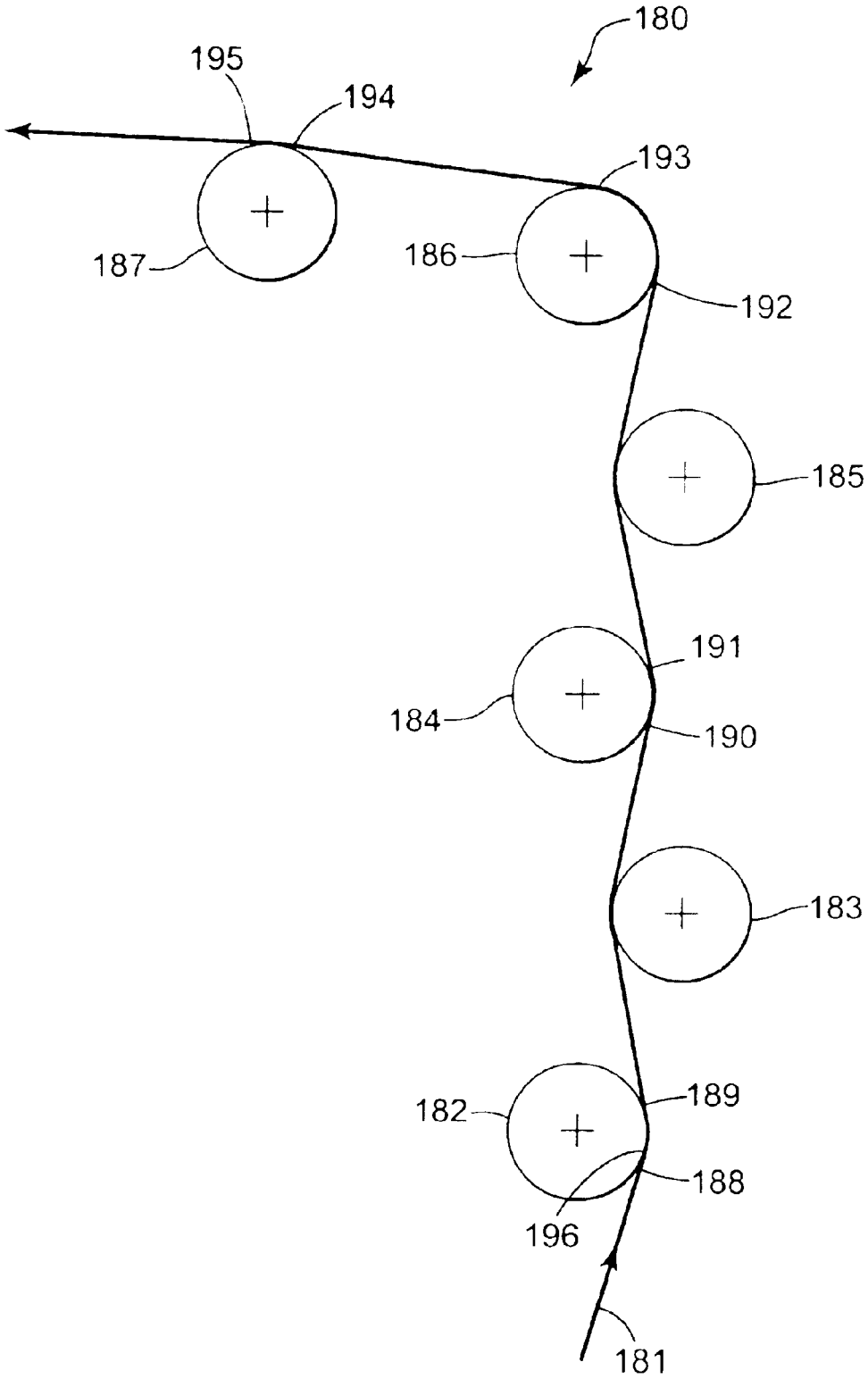
FIG. 18 is a schematic side view of an apparatus of the invention that employs an improvement station having a train of equal diameter non-equally driven contacting rolls.

FIG. 18 shows a uniformity improvement station 180 that uses a train of equally-sized, unequal speed pick-and-place roll contactors. Liquid-coated web 181 is coated on one surface (using an electrostatic spray head not shown in FIG. 18) prior to entering improvement station 180. Liquid coating caliper on web 181 spatially varies in the down-web direction at any instant in time as it approaches pick-and-place contactor roll 182. To a fixed observer, the coating caliper would exhibit time variations. This variation may contain transient, random, periodic, and transient periodic components in the down web direction. Web 181 is directed along a path through station 180 and into contact with the pick-and-place contactor rolls 182, 184, 186 and 187 by idler rolls 183 and 185. The path is chosen so that the wet coated side of the web comes into physical contact with the pick-and-place rolls. Pick-and-place rolls 182, 184, 186 and 187 (which as shown in FIG. 18 all have the same diameter) are driven so that they rotate with web 181 but at speeds that vary with respect to one another. The speeds are adjusted to provide an improvement in coating uniformity on web 181. At least two and preferably more than two of the pick-and-place rolls 182, 184, 186 and 187 do not have the same speed and are not integer multiples of one another.

Referring for the moment to pick-and place roll 182, the liquid coating splits at separation point 189. A portion of the coating travels onward with the web and the remainder travels with roll 182 as it rotates away from separation point 189. Variations in coating caliper just prior to separation point 189 are mirrored in both the liquid caliper on web 181 and the liquid caliper on the surface of roll 182 as web 181 and roll 182 leave separation point 189. After the coating on web 181 first contacts roll 182 and roll 182 has made one revolution, the liquid on roll 182 and incoming liquid on web 181 meet at entry point 188, thereby forming a liquid filled nip region 196 between points 188 and 189. Region 196 is without air entrainment. To a fixed observer, the flow rate of the liquid entering region 196 is the sum of the liquid entering on the web 181 and the liquid entering on the roll 182. The net action of roll 182 is to pick material from web 181 at one position along the web and place a portion of the material down again at another position along the web.

In a similar fashion, the liquid coating splits at separation points 191, 193 and 195. A portion of the coating re-contacts web 181 at entry points 190, 192 and 194 and is reapplied to web 181.

As with the trains of intermittent pick-and-place contacting devices discussed above, random or periodic variations in the liquid coating caliper on the incoming web will be reduced in severity and desirably the variations will be substantially eliminated by the pick-and-place action of the periodic contacting rolls of FIG. 18. Also, as with the devices discussed above, a single roll running in contact with the liquid coating on the web, or a train of periodically related rolls, will generally tend to propagate defects and produce large amounts of costly scrap.

By using multiple pick-and-place rolls we can simultaneously reduce the amplitude of and merge successive spikes or depressions together to form a continuously slightly varying but spike- and depression-free coating of good uniformity. As shown in FIG. 18, this can be accomplished by using roll devices of equal diameters driven at unequal speeds. As shown in FIG. 3*a* and FIG. 4*a*, this can also be accomplished by varying the diameters of a train of roll devices. If the rolls are not independently driven, but instead rotated by the traction with the web, then the period of each roll is related to its diameter and its traction with the wet web. Selection of differently sized rolls can require extra time for initial setup, but because the rolls are undriven and can rotate with the web, the overall cost of the improvement station will be substantially reduced.

In the absence of a detailed mathematical simulation, a recommended experimental procedure for determining a set of pick-and-place roll diameters and therefore their periods is as follows. First, measure the down web coating weight continuously and determine the period, P, of the input of an undesired periodic defect to the improvement station. Then select a series of pick-and-place roll diameters with periods ranging from less than to larger than the input period avoiding integer multiples or divisors of that period. From this group, determine which roll gives the best improvement in uniformity by itself alone: From the remaining group, select a second roll that gives the best improvement in uniformity when used with the first selected roll. After the first two rolls are determined, continue adding additional pick-and-place rolls one by one based on which from among those available will give the best improvement. The best set of rolls is dependent upon the uniformity criterion used and the initial unimproved down web variation present. Our preferred starting set of rolls include those with periods, Q, ranging from Q=0.26 to 1.97 times the period of the input defect, in increments of 0.03. Exceptions are Q=0.5, 0.8, 1.1, 1.25, 1.4, and 1.7. Periods of (Q+nP) and (Q+kP) where n is an integer and k=1/n are also suggested.

Figure 19:
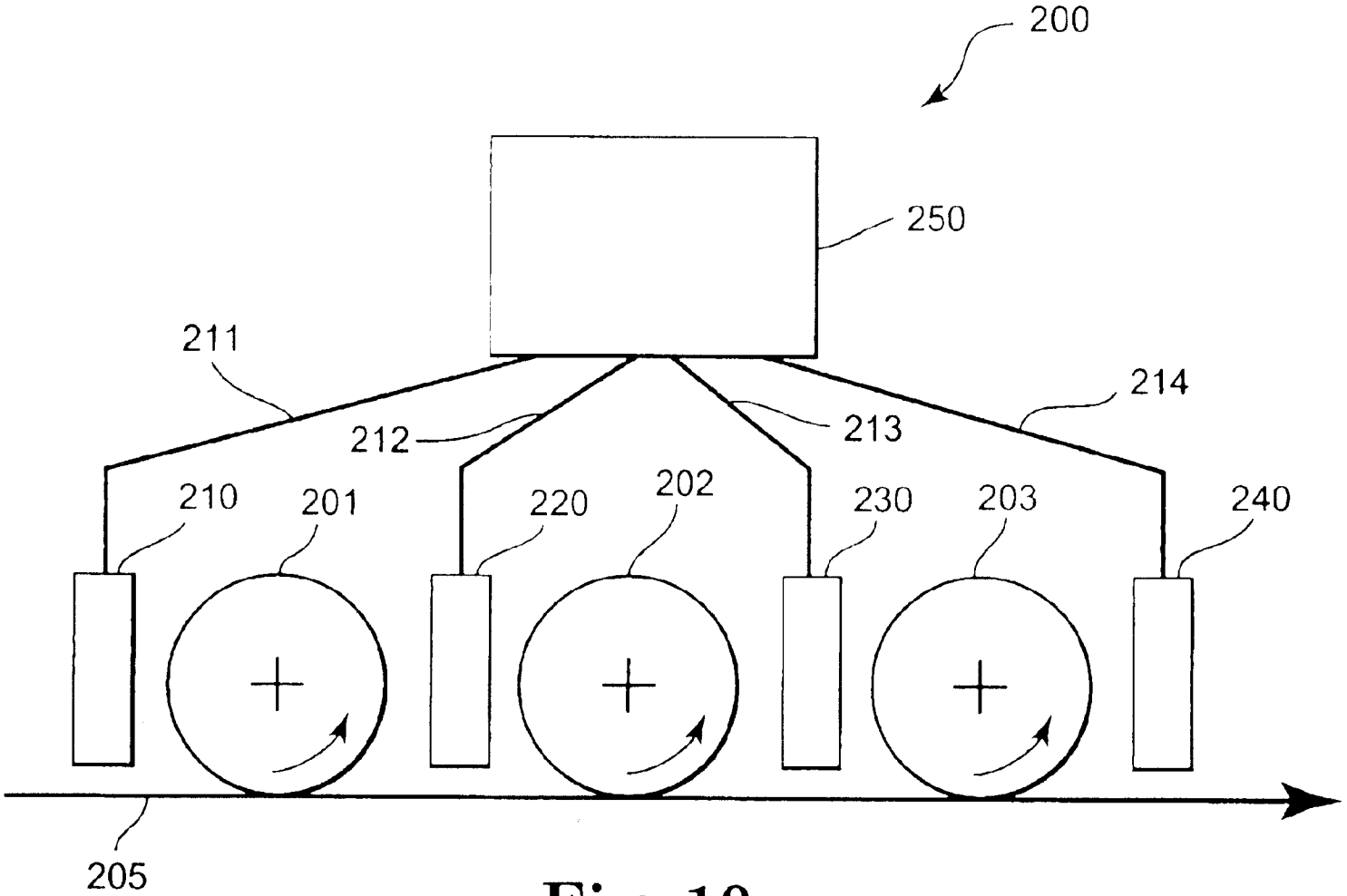
FIG. 19 is a schematic side view of a control system for use in the invention.

FIG. 19 shows a caliper monitoring and control system for use in an improvement station 200. This system permits monitoring of the coating caliper variation and adjustment in the period of one or more of the pick-and-place devices in the improvement station, thereby permitting improvement or other desired alteration of the coating uniformity. This will be especially useful if the period of the incoming deviation changes. Referring to FIG. 19, pick-and-place transfer rolls 201, 202 and 203 are attached to powered driving systems (not shown in FIG. 19) that can independently control the rates of rotation of the rolls in response to a signal or signals from controller 250. The rates of rotation need not all match one another and need not match the speed of the substrate 205. Sensors 210, 220, 230 and 240 can sense one or more properties (e.g., caliper) of substrate 205 or the coating thereon, and can be placed before or after one or more of the pick-and-place rolls 201, 202 and 203. Sensors 210, 220, 230 and 240 are connected to controller 250 via signal lines 211, 212, 213 and 214. Controller 250 processes signals from one or more of sensors 210, 220, 230 and 240, applies the desired logic and control functions, and produces appropriate analog or digital adjustment signals. These adjustment signals can be sent to the motor drives for one or more of pick-and-place rolls 201, 202 and 203 to produce adjustments in the speeds of one or more of the rolls. In one embodiment, the automatic controller 250 can be a microprocessor that is programmed to compute the standard deviation of the coating caliper at the output side of roll 201 and to implement a control function to seek the minimum standard deviation of the improved coating caliper. Depending on whether or not rolls 201, 202 and 203 are controlled individually or together, appropriate single or multi-variable closed-loop control algorithms from sensors positioned after the remaining pick-and-place rolls can also be employed to control coating uniformity. Sensors 210, 220, 230 and 240 can employ a variety of sensing systems, such as optical density gauges, beta gauges, capacitance gages, fluorescence gauges or absorbance gauges. If desired, fewer sensors than pick-and-place rolls can be employed. For example, a single sensor such as sensor 240 can be used to monitor coating caliper and sequentially or otherwise implement a control function for pick-and-place rolls 201, 202 and 203.

As noted above, the improvement station can employ driven pick-and-place rolls whose rotational speed is selected or varied before or during operation of the improvement station. The period of a pick-and-place roll can be varied in other ways as well. For example, the roll diameter can be changed (e.g., by inflating or deflating or otherwise expanding or shrinking the roll) while maintaining the roll's surface speed. The rolls do not have to have constant diameters; if desired they can have crowned, dished, conical or other sectional shapes. These other shapes can help vary the periods of a set of rolls. Also, the position of the rolls or the substrate path length between rolls can be varied during operation. One or more of the rolls can be positioned so that its axis of rotation is not perpendicular (or is not always perpendicular) to the substrate path. Such positioning can improve performance, because such a roll will tend to pick up coating and reapply it at a laterally displaced position on the substrate. The liquid flow rate to the electrostatic spray head can also be modulated, e.g., periodically, and that period can be varied. All such variations are a useful substitute for or an addition to the roll sizing rules of thumb discussed above. All can be used to affect the performance of the improvement station and the uniformity of the caliper of the finished coating. For example, we have found that small variations in the relative speeds or periodicity of one or more of the pick-and-place devices, or between one or more of the devices and the substrate, are useful for enhancing performance. This is especially useful when a limited number of roll sizes or a limited number of periods are employed. Random or controlled variations can be employed. The variation preferably is accomplished by independently driving the rolls using separate motors and varying the motor speeds. Those skilled in the art will appreciate that the speeds of rotation can also be varied in other ways, e.g., by using variable speed transmissions, belt and pulley or gear chain and sprocket systems where a pulley or sprocket diameter is changed, limited slip clutches, brakes, or rolls that are not directly driven but are instead frictionally driven by contact with another roll. Periodic and non-periodic variations can be employed. Non-periodic variations can include intermittent variations and variations based on linear ramp functions in time, random walks and other non-periodic functions. All such variations appear to be capable of improving the performance of an improvement station containing a fixed number of rolls. Improved results are obtained with speed variations having amplitudes as low as 0.5 percent of the average.

Constant speed differentials are also useful. This allows one to choose periods of rotation that avoid poor performance conditions. At fixed rotational speeds these conditions are preferably avoided by selecting the roll sizes.

Use of an electrostatic spray head and improvement station together provides a complementary set of advantages. The electrostatic spray head applies a pattern of drops onto the conductive transfer surface. If a fixed flow rate to the spray head is maintained, the substrate translational speed is constant, and most of the drops deposit upon the substrate, then the average deposition of liquid will be nearly uniform. However, since the liquid usually deposits itself in imperfectly spaced drops, there will be local variations in the coating caliper. If the average drop diameter is larger than the desired coating thickness, the drops will not initially touch, thus leaving uncoated areas in between. Sometimes these sparsely placed drops will spontaneously spread and coalesce into a continuous coating, but this may take a long time or, if the drop size distribution is large, occur in a manner that produces a non-uniform coating. The improvement station can convert the drops to a continuous coating, or improve the uniformity of the coating, or shorten the time and machine length needed to accomplish drop spreading. The act of contacting the initial drops with rolls or other selected pick-and-place devices, removing a portion of the drop liquid, then placing that removed portion back on the substrate in some other position increases the surface coverage on the substrate, reduces the distance between coated spots and in some instances increases the drop population density. The improvement station also creates pressure forces on the drop and substrate, thereby accelerating the rate of drop spreading. Thus, the combined use of an electrostatic spray head and selected pick-and-place devices makes possible rapid spreading of drops applied to a substrate, and improves final coating uniformity.

If the average drop diameter is less than the desired coating thickness and the spraying deposition rate is sufficient to produce a continuous coating, the statistical nature of spraying will nonetheless produce non-uniformities in the coating caliper. Here too, the use of rolls or other selected pick-and-place devices can improve coating uniformity.

Beneficial combinations of the electrostatic spray head and pick-and-place devices can be tested experimentally or simulated for each particular application. Through the use of our invention, 100% solids coating compositions can be converted to void-free or substantially void-free cured coatings with very low average calipers. For example, coatings having thicknesses less than 10 micrometers, less than 1 micrometer, less than 0.5 micrometer or even less than 0.1 micrometer can readily be obtained. Coatings having thicknesses greater than 10 micrometers (e.g., greater than 100 micrometers) can also be obtained. For such thicker coatings it may be useful to groove, knurl, etch or otherwise texture the surfaces of one or more (or even all) of the pick-and-place devices so that they can accommodate the increased wet coating thickness.

The improvement station can substantially reduce the time required to produce a dry substrate, and substantially ameliorate the effect of coating caliper surges. The improvement station diminishes coating caliper surges for the reasons already explained above. Even if the coating entering the improvement station is already uniform, the improvement station also greatly increases the rate of drying. Without intending to be bound by theory, we believe that the repeated contact of the wet coating with the pick-and-place devices increases the exposed liquid surface area, thereby increasing the rate of heat and mass transfer. The repeated splitting, removal and re-deposition of liquid on the substrate may also enhance the rate of drying, by increasing temperature and concentration gradients and the heat and mass transfer rate. In addition, the proximity and motion of the pick-and-place device to the wet substrate may help break up rate limiting boundary layers near the liquid surface of the wet coating. All of these factors appear to aid in drying. In processes involving a moving web, this enables use of smaller or shorter drying stations (e.g., drying ovens or blowers) down web from the coating station. If desired, the improvement station can extend into the drying station.

The methods and apparatus of the invention can be used to apply coatings on a variety of flexible or rigid substrates, including paper, plastics (e.g., polyolefins such as polyethylene and polypropylene; polyesters; phenolics; polycarbonates; polyimides; polyamides; polyacetals; polyvinyl alcohols; phenylene oxides; polyarylsulfones; polystyrenes; silicones; ureas; diallyl phthalates; acrylics; cellulose acetates; chlorinated polymers such as polyvinyl chloride; fluorocarbons, epoxies; melamines; and the like), rubbers, glasses, ceramics, metals, biologically derived materials, and combinations or composites thereof. If desired, the substrate can be pretreated prior to application of the coating (e.g., using a primer, corona treatment, flame treatment or other surface treatment) to make the substrate surface receptive to the coating. The substrate can be substantially continuous (e.g., a web) or of finite length (e.g., a sheet). The substrate can have a variety of surface topographies (e.g., smooth, textured, patterned, microstructured or porous) and a variety of bulk properties (e.g., homogenous throughout, heterogeneous, corrugated, woven or nonwoven). For example, when coating microstructured substrates (and assuming that the coating is applied from above the substrate, with the targeted microstructure being on the top surface of the substrate), the coating can readily be applied to the uppermost portions of the microstructure. The coating liquid's surface tension, the applied nip pressure (if any), and the surface energy and geometry of the microstructure will determine if coating in the lowermost (e.g., valley portions) of the microstructure will occur. Substrate pre-charging can be employed if desired, e.g., to help deposit coating within the valley portions of a microstructure. For fibrous webs coated using a drum transfer method such as shown in FIG. 1 through FIG. 3*c* or a transfer belt method such as is shown in FIG. 4*a* and FIG. 4*b*, wicking flow primarily determines the depth of penetration of the coating.

The substrates can have a variety of uses, including tapes; membranes (e.g., fuel cell membranes); insulation; optical films or components; photographic films; electronic films, circuits or components; precursors thereof, and the like. The substrates can have one layer or many layers under the coating layer.

The invention is further illustrated in the following examples, in which all parts and percentages are by weight unless otherwise indicated.

EXAMPLE 1

A 35 micrometer thick, biaxially oriented polypropylene (BOPP) web that had been flame treated on its upper side (Douglas-Hanson Company) was passed over two 7.62 cm diameter idler rolls. The idler rolls had been separated in the machine direction by a sufficient distance to allow a 50.8 cm diameter by 61 cm wide grounded stainless steel drum to be dropped in place between the idler rolls. This caused the web to contact approximately one-half the circumference of the drum and forced the drum to co-rotate at the 15.2 m/min surface speed of the moving web. A solventless silicone acrylate UV curable release formulation like that of Example 10 of U.S. Pat. No. 5,858,545 was prepared and modified by the addition of 0.3 parts per hundred (pph) of 2,2'-(2,5-Thiophenediyl)bis[5-tert-butylbenzoxazole] (UVITEX™-OB fluorescing dye, Ciba Specialty Chemicals Corp.)

An electrostatic spray head that could operate in the electrospray mode like that of U.S. Pat. No. 5,326,598 was modified to operate in the restricted flow mode described in U.S. Pat. No. 5,702,527, and set up to operate using grounded field adjusting electrodes (also known as "extractor rods") and with a −30 kV voltage between the spray head die wire and ground. The above-described release formulation was electrosprayed onto the top of the rotating metal drum at a flow rate sufficient to produce a 1 micrometer thick coating on the drum. After a few rotations of the drum, the surface of the drum became wet with the release coating and an equilibrium was reached. As the drum rotated past the electrospray coating head, the drops in the electrospray mist were attracted to the grounded drum where the charges on the drops were dissipated. The electrical conductivity of the release coating was about 40 microSiemens/m with a dielectric constant of about 10, so the applied coating required only a few microseconds to bleed off its charge to the drum. Thus, after landing on the drum the charge on the drops dissipated in less than one centimeter of drum surface movement. As the drum rotated past the moving web, the applied drops contacted the web surface. When the web left the rotating drum, some of the coating liquid remained on the drum while the rest remained on the web, forming a 1 micrometer thick coating. Some elliptical uncoated areas were observed on the coated web. These were thought to be due to air entrainment between the drum and the web. These uncoated areas could be prevented by pressing a paper towel inward against the backside of the web, at the initial coating line where the drum first contacted the web. It is believed that these uncoated areas could also be discouraged or eliminated by using lower web speed (e.g., a speed low enough to permit the wetting line to advance at the same rate as the web) or by altering the web tension, coating liquid chemistry, web composition, web microstructure or web surface treatment. For example, a non-woven or other porous web would be much less susceptible to uncoated areas due to air entrainment.

The coated web appeared to have no residual charge. Ordinarily, electrostatic spray coating of such a web would have required pre-charging. However, as shown above, coating was accomplished without placing a pre-charge or net charge on the web, and without requiring web neutralization.

EXAMPLE 2

The apparatus of Example 1 was modified by installing a nip roll that pressed against the underside of the drum at the initial coating line where the liquid first contacted the web. Except for two locations where small gouges (indentations) were present on the nip roll, use of the nip roll eliminated all uncoated areas on the web, and provided a coating having visually improved uniformity. The improved uniformity could be verified by shining a Model 801 "black light" fluorescent fixture (Visual Effects, Inc.) on the wet coating. The UVITEX™ OB fluorescing dye in the release coating radiates blue light under such illumination, and provided a readily discernable illustration of the amount and uniformity of the thin coating deposited the web.

EXAMPLE 3

The apparatus of Example 1 was modified by adding an eight roll improvement station after the second idler roll, and routing the coated web through the improvement station so that the wet side of the web contacted the eight pick-and-place rolls as shown in FIG. 3*a*. The eight rolls had respective diameters of 54.86, 69.52, 39.65, 56.90, 41.66, 72.85, 66.04, and 52.53 mm, all with a tolerance of plus or minus 0.025 mm. The rolls were obtained from Webex Inc. as dynamically balanced steel live shaft rolls with chrome plated roll faces finished to 16 Ra. The improvement station eliminated all uncoated areas on the web, including the gouge marks caused by the indentations on the nip roll, and provided a coating having further visually improved uniformity when evaluated using black light illumination.

COMPARISON EXAMPLE 1

Using the electrostatic spray head and coating of Example 1, the coating liquid was electrostatically sprayed directly onto a 30.5 cm wide by 34.3 micrometer thick polyethylene terephthalate (PET) web (3M) routed atop a rotating grounded drum (rather than under the drum as in Example 1). In order to permit the drops to deposit and coalesce into a coating, the web was pre-charged by first passing the web under a series of three two-wire corotron chargers each held at a wire voltage of +8.2 kV with respect to ground. The housings of all three corotron charges were grounded. As the web passed beneath the corotron chargers, a portion of the corotron current deposited charge on the web while the remainder of the current went to the grounded corotron housings. So long as the amount of charge deposited by these pre-charging devices is sufficiently high, the atomized drops from the electrostatic spray head will all be attracted towards the web and a coating having a predictable average thickness will be produced. However, the coated pre-charged web typically will have to be neutralized to remove excess charge from the web. Often one or more additional (oppositely-charged) corotron chargers can be used for that purpose. The pre-charging and neutralization devices must be set up and adjusted with care, and failure of the neutralization device will cause residual charge to be stored on the web.

In a series of runs, the spray head pump flow rate was held fixed at 5.8 or 8.5 cc/min and the web speed was varied from 15 to 152 m/min to deliver a variety of coating thicknesses as set out below in Table I:

TABLE I

| Run No. | Flow Rate, cc/min | Web Speed, m/min | Coating Thickness, $\mu$m |
|---|---|---|---|
| C-1 | 5.8 | 15 | 1.0 |
| C-2 | 5.8 | 61 | 0.25 |
| C-3 | 8.5 | 152 | 0.1 |
| C-4 | 8.5 | 15 | 1.0 |
| C-5 | 5.8 | 30 | 0.5 |
| C-6 | 5.8 | 61 | 0.25 |
| C-7 | 8.5 | 122 | 0.125 |
| C-8 | 8.5 | 152 | 0.1 |

A MONROE™ Model 171 electrostatic field meter with its sensor head positioned 1 cm from the grounded drum was used to monitor the voltage on the upper surface of the web after pre-charging by the corotron chargers. For this comparison example the field meter was not connected in a feedback loop with the corotron chargers as would normally be done in a typical coating operation where a fixed web voltage or web charge would be desired. For the web speeds listed in Table I, the measured web voltages (field meter measurement multiplied by 1 cm) were between 500 and 1200 volts with the lower voltages being obtained at the higher web speeds. The PET web had a dielectric constant of 3.2. The observed 500 to 1200 volts/cm field meter measurements corresponded to a positive charge of 413 to 991 $\mu$C/m$^2$ (calculated according to Equation 7 of Seaver, A. E., Analysis of Electrostatic Measurements on Non-Conducting Webs; *J. Electrostatics,* Vol. 35, No. 2 (1995), pp. 231–243). These charge levels were less than the charge required to cause an electrical breakdown within the PET. The electrical breakdown strength of PET is 295 volts/micrometer (Polymer Handbook, 3$^{rd}$ Edition, Editors J. Brandrup and E. H. Immergut, Wiley, New York (1989) page V/101). A calculated charge of 8354 $\mu$C/m$^2$ would be required to cause an electrical breakdown within the PET web.

In general, a charged drop can possess any amount of charge up to the so-called Rayleigh charge limit (Cross, J. A., Electrostatics: Principles, Problems and Applications, Adam Hilger, Bristol (1987), page 81). The Rayleigh charge limit is dependent on both the size and surface tension of the drop. The electrostatic sprayhead used in this comparison example produced negatively-charged drops having sizes of about 30 micrometers and a surface tension of 21 mN/m. When these charged drops landed on the web they charged the web. A conservation of volume calculation shows that if such drops are charged to the Rayleigh charge limit and deposited on a web to produce a 1 micrometer thick coating, the drops would deposit 44.5 $\mu$C/m$^2$ of negative charge on the web. The electrostatic sprayhead used in this comparison example typically charges the drops to at least about one half the Rayleigh limit, and thus deposited between about 22 and 44.5 $\mu$C/m$^2$ of negative charge on the web for the above-described 1 micrometer thick coating. This negative charge was well below the 431 to 991 $\mu$C/m$^2$ positive web pre-charge deposited by the corotron chargers, and well below the 8354 $\mu$C/m$^2$ of charge required for electrical breakdown of the PET web.

These calculations help to predict the behavior of the pre-charged web when it is removed from the drum for further processing. As noted above, at a measured pre-charge of 1200 volts, 991 $\mu$C/m$^2$ of positive charge is present on the web before the coating is applied. After deposition of the coating, about 947 to 966 $\mu$C/m$^2$ of positive charge remains on the coated surface of the web. Electric fields begin and end on charges. A 947 $\mu$C/m$^2$ positive charge on the coated surface of the web corresponds to a 947 $\mu$C/m$^2$ negative charge on the uncoated web surface lying against the grounded drum, and these charges produce electric field lines between the surface of the coated web and the surface of the drum which pass through the web. When the web is removed from the drum, these electric field lines pass through both the web and the air space between the uncoated surface of the web and the grounded drum. Because only about 25 $\infty$C/m$^2$ of charge is needed to cause a breakdown in the air (see Seaver, id at page 236–237), the residual positive charge remaining on the web will be over an order of magnitude greater than the surface charge density needed to break down this air space. Consequently, if the web is not first further neutralized by depositing more negative charge onto the coated surface before the web is removed from the grounded metal drum, a continuous air discharge takes place between the back of the moving web and the drum near the separation point.

COMPARISON EXAMPLE 2

In a further set of runs, the coated web was pre-charged and coated at various web speeds as in Comparison Example 1, but not neutralized. The web was purposely removed from the grounded drum with the residual positive charge still remaining on the web. The removal process produced a backside discharge near the separation line and deposited negative charge on the uncoated side of the web. The coated web was then passed through a UV cure chamber having an inert atmosphere containing less than 50 ppm of oxygen, and cured with at least 2 mJ/cm$^2$ of UVC energy (250–260 nm). The UVC energy density or dose D was measured using a UVIMAP™ Model No. UM254L-S UV dosimeter (Electronic Instrumentation and Technology, Inc.) and found to be in agreement with the simple equation DS=C where S is the web speed and C is a constant defined for a specific total power input to the UV lights. For example, at a web speed of 15 m/min, the dose was calculated to be 32 mJ/cm$^2$. The cured coated web was passed over several rolls on its way to being wound up into a roll, with the coated side touching a polytetrafluoroethylene-coated dancer-roll, a silicone-rubber pinch roll and three aluminum rolls. Only metal rolls touched the backside of the web. Because polytetrafluoroethylene and silicone rubber are at the lower or negative end of the triboelectric series (Dangelmayer, G. T., ESD Program Management, Van Nostrand Reinhold, New York (1990) page 40), some positive charging of the coated surface is typically expected to occur during transport over the rollers. Samples of approximately 30.5 cm by 30 cm were cut from the coated web rolls for each web speed. Each cut sample was first placed on a 40 cm by 40 cm grounded metal plate with the coated side facing up. The metal plate could be slid horizontally in various directions beneath the sensor of a TREK™ 4200 electrostatic voltmeter placed 5 mm above the cut sample. The metal plate was moved to various positions under the sensor so that high, low and average web voltage values could be recorded for whichever side was face-up for each cut sample. A plot of the average residual voltage vs. web speed for the coated side is shown as curve A in FIG. 20. Most of the charge deposited by the corotron pre-chargers on the coated side of the web remained with the web. A curve similar to curve A in FIG. 20, but exhibiting negative voltage, was measured on the backside of the web. Thus this comparison example shows that when a neutralizing device fails for any reason, a highly charged web will be produced, even though both sides of the coated, charged web contacted metal rolls.

COMPARISON EXAMPLE 3

Using the method of Comparison Examples 1 and 2 and the coating of Example 1, a moving web was pre-charged, coated using the electrostatic spray head and then passed (without separate charge neutralization) through the eight roll improvement station of Example 3. In addition to improving the coating as described above, the improvement station rolls provided a further ground path for neutralization of the residual charge on the coated surface of the web. However, because negative charges were deposited on the backside of the web when the web was removed from the grounded drum, these negative charges acted to hold an equivalent amount of positive charge on the coated side of the web.

The electrostatic spray head pump flow rate was held fixed at either 5.8 cc/min or 11.6 cc/min and the web speed was changed to deliver a variety of coating thicknesses as set out below in Table II:

TABLE II

| Run No. | Flow Rate, cc/min | Web Speed, m/min | Coating Thickness, $\mu$m |
|---|---|---|---|
| C-9 | 5.8 | 15 | 1.0 |
| C-10 | 5.8 | 30 | 0.5 |
| C-11 | 5.8 | 61 | 0.25 |
| C-12 | 5.8 | 122 | 0.125 |
| C-13 | 5.8 | 152 | 0.1 |
| C-14 | 11.6 | 61 | 0.5 |
| C-15 | 11.6 | 305 | 0.1 |

Because higher web speeds were employed, the corotron pre-chargers were operated at +8.8 kV. A sample was taken from each coated roll at the various web speeds shown in Table II, and the web voltages were again measured as in Comparison Example 2. A plot of the average residual voltage of the coated side with the backside resting on a grounded plate vs. web speed is shown as curve B in FIG. 20. As can be seen by comparing curves A and B, whether or not the improvement rolls are employed, considerable residual charge remains on the coated web. Accordingly, when counter-charges are present on the backside of a pre-charged web, passage of the coated side of the web over a train of metal improvement rolls will not remove the residual charge.

EXAMPLE 4

Using the apparatus of Example 3 (which included a nip roll and an eight roll improvement station), the coating of Example 1 was applied to the web and cured as in Comparison Examples 2 and 3, using a pump flow rate of 5.8 cc/min, web speeds of 15 to 152 m/min and a nip pressure of 276 kPa. Samples were taken from the coated rolls at the various web speeds and the residual web voltages were again measured. A plot of the average residual voltage vs. web speed is shown as curve C in FIG. 20. As can be seen by comparing curve C to curves A and B, very little residual charge remained on the web, even at low web speeds.

Figure 20:
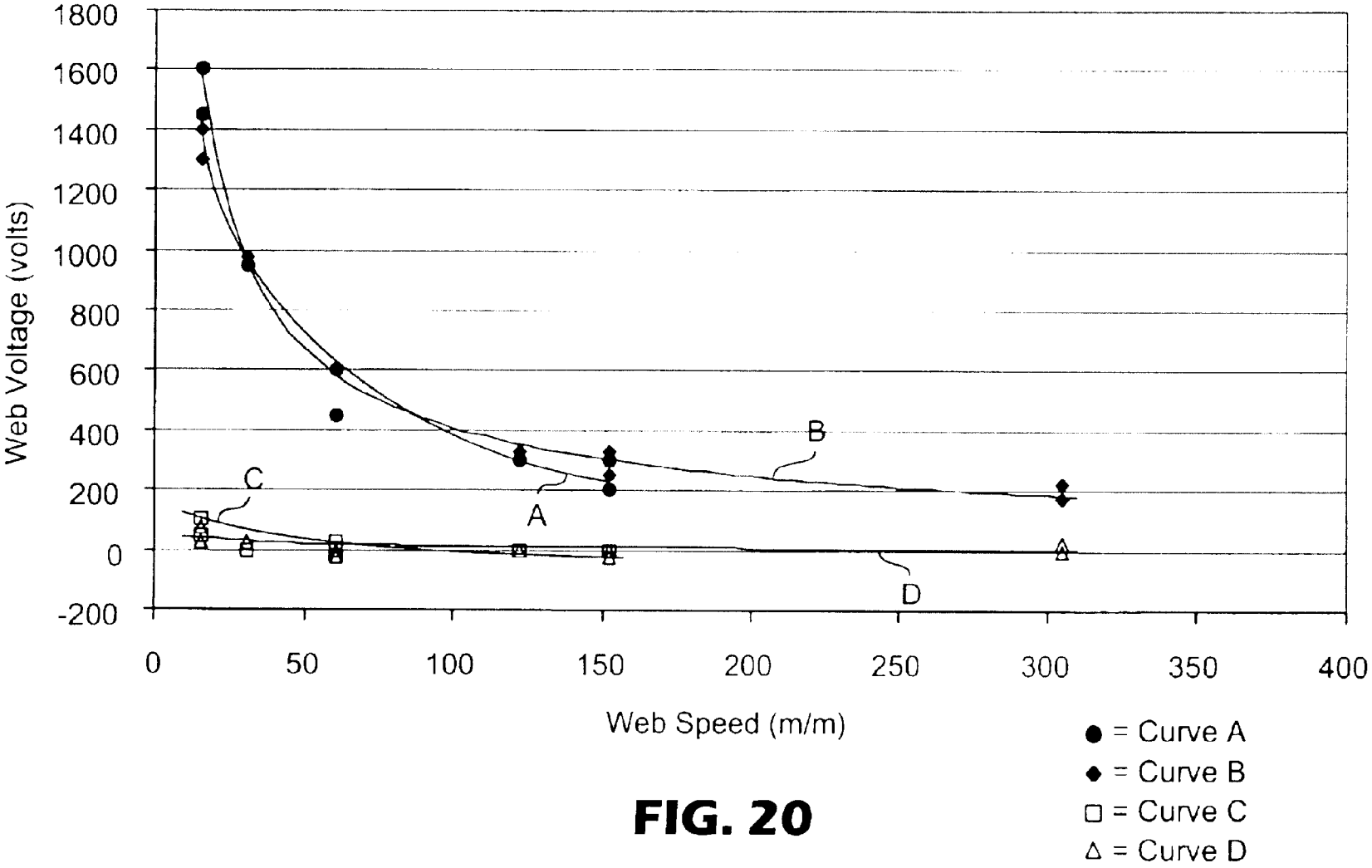
FIG. 20 is a graph showing residual web voltage vs. web speed for various coating conditions.

For a 1 micrometer thick coating, the drops would be expected to deposit at least 22 $\mu C/m^2$ of negative charge and the electrostatic voltmeter would be expected to measure −27 volts on the coated side. The values shown in FIG. 20 show a positive rather than a negative voltage, suggesting that triboelectric charging by the silicone-rubber and polytetrafluoroethylene rolls may be responsible for the charge on the coated web. Triboelectric charging is a function of the time of contact. Curve C in FIG. 20 shows that at shorter contact times (higher speeds) the effect of triboelectric charging diminishes and the measured residual web voltage is zero or nearly zero.

EXAMPLE 5

Example 4 was repeated using the apparatus of Example 2 (which did not include an improvement station), pump flow rates of 5.8 cc/min or 11.6 cc/min., web speeds of 15 to 305 m/min and a nip pressure of 276 kPa. Samples were taken from the coated rolls at the various web speeds and the residual web voltages were again measured. A plot of the average residual voltage vs. web speed is shown as curve D in FIG. 20. As can be seen by comparing curve D to curves A through C, at low speeds the residual web voltage is still positive, but less than in curve C when improvement rolls were present. This verifies that the charge on the drops leaked off at the rotating grounded drum rather than at the improvement rolls. The improvement rolls are believed to allow some triboelectric charging to occur as the coated web passes the polytetrafluoroethylene-coated dancer-roll and silicone-rubber pinch roll on its way to being wound up. Since the electrical conductivity of the coating solution was measured at 18 microSiemens per meter ($\mu$S/m) the electrical relaxation time is on the order of only a few microseconds. Recognizing the rapid electrical relaxation time of the coating liquid, and comparing curves C and D at the lowest web speed, the charge caused by electrostatic spraying appears to have been fully neutralized by the rotating grounded drum, and residual charge appears not to have been transferred to the web by the electrostatic coating process of the invention.

EXAMPLE 6

Using the apparatus of Example 3, the coating of Example 1 was spray-applied to the drum and then transferred to a 30.48 cm wide BOPP web running at 15.24 m/min. The flow rate to the die was changed to produce various decreasing coat heights, and then the flow rate was held fixed and the web speed was increased to 60.96 m/min to obtain an even thinner coating. After the coated web passed through the pick-and-place rolls, the coating was UV cured and wound up on a take-up roll. The coated web was then unwound so that 30 cm long web samples could be removed for each coating condition. The backside of each web sample was marked with an elongated spot using black ink to denote the web centerline. Each sample was then placed beneath the sensor of a model LS-50B Luminescence Spectrophotometer (Perkin Elmer Instruments). Using the marked centerlines, the center of each web sample was pulled past the sensor in the down-web direction, at a rate of about 1 cm/sec. The average value of the fluorescence intensity during the scan was recorded. A sample of uncoated BOPP web was also removed from the supply roll and evaluated as a control to determine the normal fluorescence intensity of the uncoated web. The sample numbers, web coating speed, coating height and fluorescence intensity are set out below in Table III.

TABLE III

| Sample No. | Web Speed, M/min | Coating Height, micrometers | Fluorescence Intensity |
|---|---|---|---|
| Control | — | — | 12.49 |
| 6-1 | 15.24 | 2 | 245.54 |
| 6-2 | 15.24 | 1.25 | 160.98 |
| 6-3 | 15.24 | 0.62 | 89.79 |
| 6-4 | 60.96 | 0.16 | 40.33 |

Figure 21:
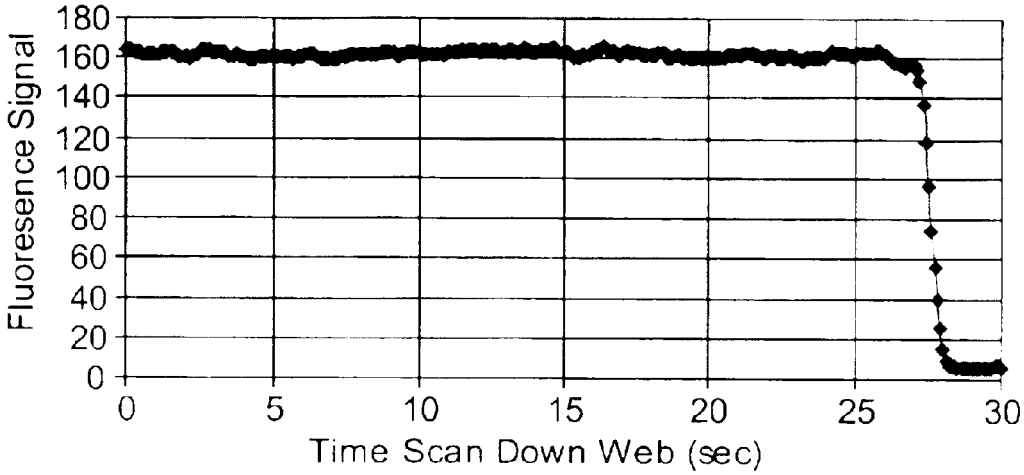
FIG. 21 is a graph showing a down-web scan of coating fluorescence.

The down-web scan of Sample No. 6-2 is shown in FIG. 21, and is representative of the other scans. The scan remained uniform along the length of the sample, indicative of a highly uniform down-web coating. The decrease in signal strength near the end of the scan arose when the end of the sample passed the sensor.

Figure 22:
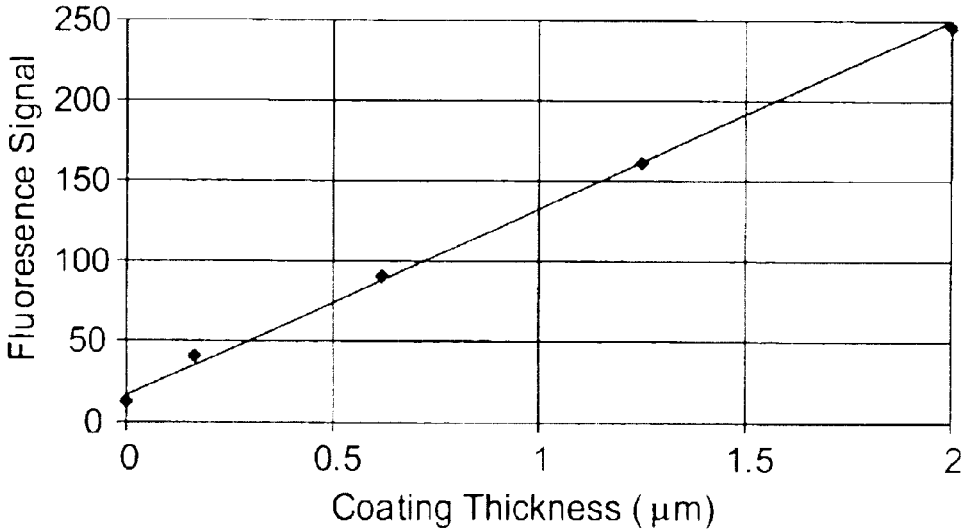
FIG. 22 is a graph showing coating fluorescence vs. calculated coating height.

The coating heights were calculated based on the flow rate to the spray head, the web speed and an assumption that there was no loss of coating between the spray head and the drum. FIG. 22 shows a plot of the fluorescence signal against the calculated coating height. The data points fall on a straight line, indicating that the method of the invention provided good control of the coating caliper over a wide range of thin-film coat heights.

EXAMPLE 7

The apparatus of Example 3 was modified by mounting the metal drum in a fixture like that shown in FIG. 3*a* through FIG. 3*c* and using it to apply the coating of Example 1 to BOPP and PET webs. The wire 36 of the electrostatic spray coating head 31 was held at a fixed distance of 10.8 cm from the surface of the drum 14. The electrostatic coating head slot 34 was 33 cm wide. However, due to charge repulsion between the atomized drops, the spray coating head 31 was capable of spraying a 38 cm wide mist across the drum 14. A nip roll 26 having an overall outside diameter of 10.2 cm was placed against the drum 12 and held in position by two air cylinders. Nip roll 26 had a 0.794 cm thick polymeric covering layer with an 80 durometer hardness. The web 16 was brought into the apparatus 30 by first wrapping it over a 7.6 cm diameter idler roll and then passing it through the nip. After the entry point, the web remained in contact with the drum 14 for approximately 61 cm of the drum circumference. The web next passed over two idler rolls and into the eight roll improvement station. The path length from the nip to the start of the improvement station was 0.86 m, and the path length through the improvement station was 1.14 m.

When a voltage of −30 kV was applied to the wire 36, the liquid coating solution created a set of mists 13*a* that broke up into drops of liquid 13 which were attracted to the grounded drum 14. Grounded side pans 12*a* and 15*a* having a width of 14 cm and a length of 25.4 cm were placed below the ends of the spray head 31 and at a location just above the grounded drum 12. Side pans 12*a* and 15*a* masked off the coating area and ducted away excess coating, and could be adjusted from side to side on sliding rods 12*b* and 15*b* to permit coating widths of 10 to 38 cm. Only the mist falling between the side pans 12*a* and 15*a* reached the grounded drum 12.

A 23.4 micrometer thick, 30.5 cm wide polyester (PET) web was passed through the nip and the side pans were separated by a distance of 15.25 cm. The web speed was fixed at 15.2 m/min. The flow rate to the electrostatic spray head was adjusted to apply a 1 micrometer thick coating of the formulation of Example 1 to the web and the nip pressure was varied. For this combination of substrate, coating liquid, nip roll diameter and durometer against a stainless steel drum, we found that the overall coating width increased from 15 cm to 24 cm as nip pressure increased from 0 to 0.55 MPa. In a second run, the substrate was changed to 33 micrometer BOPP, the side pans were separated by 20.32 cm and the nip pressure was again varied. The overall coating width did not change when the nip pressure was varied from 0.0 to 0.55 MPa.

Next, the nip pressure was set to 0.275 MPa and a BOPP web was coated at various thicknesses with the coating of Example 1, cured as in Comparison Example 2 and then wound up into a roll. The coating thicknesses were calculated based on the web speed and the flow rate of the coating liquid to the electrostatic spray head. The sample number, web speed, flow rate, calculated coating height and cure time are set out below in Table IV.

TABLE IV

| Sample No. | Web Speed, m/min | Flow Rate, cc/min | Coating Height, micrometers | Cure Time, sec |
|---|---|---|---|---|
| 7-1 | 91.44 | 11.67 | 0.335 | 1.8 |
| 7-2 | 60.96 | 11.61 | 0.5 | 2.7 |
| 7-3 | 30.48 | 11.61 | 1 | 5.4 |
| 7-4 | 15.24 | 11.61 | 2 | 10.8 |
| 7-5 | 91.44 | 7.31 | 0.21 | 1.8 |
| 7-6 | 60.96 | 7.20 | 0.31 | 2.7 |
| 7-7 | 30.48 | 7.26 | 0.625 | 5.4 |
| 7-8 | 15.24 | 7.26 | 1.25 | 10.8 |
| 7-9 | 91.44 | 3.48 | 0.1 | 1.8 |
| 7-10 | 60.96 | 3.72 | 0.16 | 2.7 |
| 7-11 | 30.48 | 3.60 | 0.31 | 5.4 |
| 7-12 | 15.24 | 3.60 | 0.62 | 10.8 |

Small 30.5 cm by 25.4 cm samples of the coated web were cut from each roll and placed under a black light in order to evaluate coating width. The coating of sample no. 7-4 was 27 cm wide, and the coating of sample no. 7-8 was 25 cm wide. The remaining coatings were 20.3 cm wide and exhibited no spreading. The samples were then scanned with the spectrophotometer used in Example 6 and found to exhibit reasonably good cross-web thickness uniformity, typically within about ±10% of the average coating thickness.

COMPARISON EXAMPLE 4

An attempt was made to coat an electrically non-conductive porous cloth web (Aurora Textile Finishing Co.) at a web speed of 30.5 m/min with a 0.4 micrometer thick coating of the formulation of Example 1, using the method of Comparison Example 1. Under the influence of the electric field lines, the applied drops passed through the pores of the web, reached the rotating grounded drum and formed a coating on the drum. This coating transferred to the backside of the web, rather than remaining only on the upper surface of the web as intended. Thus an attempt to coat only one side of the web was unsuccessful.

EXAMPLE 8

Using the method of Example 7, the electrically nonconductive porous cloth web used in Comparison Example 4 was coated at a web speed of 30.5 m/min with a 0.4 micrometer thick coating of the formulation of Example 1. The coating was sprayed onto the rotating grounded drum and then transferred to the porous web. The coating remained on the upper side of the web without wicking to the web backside, because the time required for wicking to occur was less than the time between the coating step and the curing step. The amount of the coating applied to the upper side of the web could be adjusted by altering the process parameters, without regard to the web pore size.

Peel strength was evaluated by applying 2.54 cm wide strips of No. 845 book tape (3M) to the upper (coated) side and backside of samples of the coated web, and to the corresponding sides of control samples of the uncoated web. The samples were aged for seven days at room temperature or at 70° C. The nature of the applied coating was evaluated by measuring the 180° peel force required to remove the tape. Samples in which the tape had been applied to an uncoated portion of the web tended to lift from the bed of the peel tester, leading to fabric stretch that may have affected the peel measurements. Transfer of the coating was evaluated by re-adhering the removed tape samples to clean glass, and then measuring the 180° peel force required to remove the tape from the glass. The sample description and peel strength values are set out below in Table V.

TABLE V

| | Aged 7 days RT | | Aged 7 days 70° C. | |
|---|---|---|---|---|
| Description | Release, kg/m | Re-adhesion, kg/m | Release, kg/m | Re-adhesion, kg/m |
| Coated web, upper side | 13.1 | 31.0 | 8.2 | 36.1 |
| Coated web, backside | 30.1 | 26.4 | 13.4 | 32.4 |
| Control, upper side | 33.4 | 18.0 | 20.2 | 22.0 |
| Control, backside | 31.1 | 18.0 | 16.8 | 25.5 |

The data in Table V show that the applied coating provided good release properties on the upper side of the coated web, and did not cause transfer of the release coating to the adhesive of the Book Tape. The backside of the coated web behaved like the control web in respect to its release and re-adhesion properties. The good release and re-adhesion properties of the adhesive against the applied coating were maintained even if the coating was heat aged at 70° C. This data thus demonstrates the utility of the present invention for coating thin films onto nonconductive porous webs without unduly affecting the properties of the uncoated side of the web.

Various modifications and alterations of this invention will be apparent to those skilled in the art without departing from the scope and spirit of this invention. This invention should not be restricted to that which has been set forth herein only for illustrative purposes.

We claim:

1. A method for forming a liquid coating on a substrate comprising electrostatically spraying drops of the liquid onto a liquid-wetted target region of a conductive transfer surface, wherein the target region is at a lower voltage than the drops and has a continuous coating of the liquid before newly-applied drops land, and contacting the transfer surface against the substrate to transfer a portion of the continuous coating from the transfer surface to the substrate to form a wet coating.

2. A method according to claim 1 wherein the transfer surface circulates.

3. A method according to claim 2 wherein the transfer surface comprises a drum.

4. A method according to claim 3 wherein the drum is grounded.

5. A method according to claim 2 wherein the transfer surface comprises a belt.

6. A method according to claim 1 wherein one or more nip rolls force the substrate against the transfer surface, thereby spreading the applied drops on the transfer surface and decreasing the time required for the drops to coalesce into the continuos coating of liquid on the transfer surface.

7. A method according to claim 6 wherein the nip roll causes the wet coating to have visually improved uniformity.

8. A method according to claim 1 wherein the substrate has a direction of motion and the wet coating is contacted by two or more pick-and-place devices that improve the uniformity of the wet coating in the direction of motion.

9. A method according to claim 8 wherein at least one of the pick-and-place devices comprises a roll.

10. A method according to claim 9 comprising three or more pick-and-place rolls.

11. A method according to claim 10 wherein three or more of the rolls have different diameters.

12. A method according to claim 11 wherein at least one of the rolls is undriven.

13. A method according to claim 11 wherein all of the rolls are undriven.

14. A method according to claim 1 wherein the substrate has a direction of motion and the transfer surface comprises a rotating endless belt contacted by two or more pick-and-place devices that improve the uniformity of the wet coating in the direction of motion.

15. A method according to claim 1 wherein the substrate comprises an insulative substrate.

16. A method according to claim 15 wherein the substrate is coated without pre-charging the substrate.

17. A method according to claim 1 wherein the substrate comprises paper, plastic, rubber, glass, ceramic, metal, biologically derived material, or a combination or composite thereof.

18. A method according to claim 17 wherein the substrate comprises a polyolefin, polyimide or polyester.

19. A method according to claim 1 wherein the wet coating is transferred from the conductive transfer surface to a second transfer surface and thence to the substrate.

20. A method according to claim 1 wherein the substrate comprises a porous substrate.

21. A method according to claim 1 wherein the substrate comprises a woven or nonwoven web.

22. A method according to claim 1 wherein the substrate comprises a porous substrate, one or more nip rolls force the substrate against the transfer surface and the substrate is coated without substantial penetration of the coating through the substrate.

23. A method according to claim 1 wherein the substrate comprises an electronic film, electronic component or precursor thereof.

24. A method according to claim 1 wherein the wet coating is dried, cured or otherwise hardened and has a final caliper.

25. A method according to claim 24 wherein the drops have an average diameter that is greater than the caliper and the wet coating is substantially void-free.

26. A method according to claim 24 wherein the caliper is less than about 10 micrometers.

27. A method according to claim 24 wherein the caliper is less than about 1 micrometer.

28. A method according to claim 24 wherein the caliper is less than about 0.1 micrometer.

29. A method according to claim 24 wherein the caliper is greater than about 10 micrometers.

30. A method according to claim 24 wherein the caliper is greater than about 100 micrometers.

31. A method according to claim 1 wherein the drops are neutralized on the transfer surface before being transferred to the substrate.

32. A method according to claim 1 wherein the coating is applied in one or more stripes that wholly or partially overlap, that abut one another, or that are separated by uncoated substrate.

* * * * *

UNITED STATES PATENT AND TRADEMARK OFFICE

CERTIFICATE OF CORRECTION

PATENT NO. : 6,969,540 B2
DATED : November 29, 2005
INVENTOR(S) : Seaver et al.

It is certified that error appears in the above-identified patent and that said Letters Patent is hereby corrected as shown below:

Column 8,
Line 21, delete “44ia” and insert -- 44a --.

Column 16,
Line 14, delete “alone:” and insert -- alone. --.
Line 57, delete “multi-variable” and insert -- multivariable --.

Column 22,
Line 37, delete “25 $\infty$C/m$^{2}$” and insert -- 25 $\mu$C/m$^{2}$ --.

Column 28,
Line 21, delete “continuos” and insert -- continuous --.

Signed and Sealed this

Thirtieth Day of May, 2006

JON W. DUDAS
*Director of the United States Patent and Trademark Office*